US009400148B2

(12) United States Patent
Pittman et al.

(10) Patent No.: US 9,400,148 B2
(45) Date of Patent: Jul. 26, 2016

(54) REMOVABLE SHOTGUN MAGAZINE

(71) Applicant: Sturm, Ruger & Company, Inc., Southport, CT (US)

(72) Inventors: Jason Pittman, Andover, NH (US); Dwight Potter, Unity, NH (US); Scott Warburton, South Acworth, NH (US)

(73) Assignee: STRUM, RUGER & COMPANY, INC.

( * ) Notice: Subject to any disclaimer, the term of this patent is extended or adjusted under 35 U.S.C. 154(b) by 0 days.

(21) Appl. No.: 14/500,015

(22) Filed: Sep. 29, 2014

(65) Prior Publication Data

US 2015/0089855 A1 Apr. 2, 2015

Related U.S. Application Data

(60) Provisional application No. 61/883,633, filed on Sep. 27, 2013.

(51) Int. Cl.

| | |
|---|---|
| ***F41A 9/72*** | (2006.01) |
| *F41A 9/66* | (2006.01) |
| *F41A 9/70* | (2006.01) |

(52) U.S. Cl.
CPC ... *F41A 9/72* (2013.01); *F41A 9/66* (2013.01); *F41A 9/70* (2013.01)

(58) Field of Classification Search
CPC ..... F41A 9/72; F41A 9/61; F41A 9/64; F41A 11/02
See application file for complete search history.

(56) References Cited

U.S. PATENT DOCUMENTS

| | | | | |
|---|---|---|---|---|
| 3,373,520 | A | 3/1968 | Into | |
| 3,399,481 | A * | 9/1968 | Giorgini | F41A 9/18 42/17 |
| 3,520,400 | A | 7/1970 | Gates | |
| 4,121,365 | A | 10/1978 | Hodil | |
| 4,141,164 | A | 2/1979 | Hillberg | |
| 4,174,654 | A | 11/1979 | Liedke | |
| 4,207,797 | A | 6/1980 | Gyorik | |
| 4,509,284 | A | 4/1985 | Naber | |

(Continued)

FOREIGN PATENT DOCUMENTS

| | | |
|---|---|---|
| EP | 11914501 | 4/2008 |
| FR | 2667685 | 4/1992 |

(Continued)

OTHER PUBLICATIONS

Corresponding International Search Report and Written Opinion for PCT/US14/58037 dated Mar. 3, 2015.

*Primary Examiner* — Troy Chambers
*Assistant Examiner* — Bridget Cochran
(74) *Attorney, Agent, or Firm* — The Belles Group, P.C.

(57) ABSTRACT

A magazine assembly for a firearm in one embodiment includes an outer magazine housing configured for attachment to a firearm and a magazine removably insertable into the housing. The magazine includes an axially extending internal cavity configured to hold a plurality of ammunition shells in stacked end-to-end relationship. In one embodiment, the magazine has an elongated tubular body. A shell catch lever is slideably mounted on the magazine for linear and pivoting movement in one arrangement. The shell catch lever retains a shell in the magazine in a first lateral position and releases the shell from the magazine in a second lateral position. The shell catch lever operates to retain and release shells from the magazine when either removed from or positioned in the magazine housing for loading the firearm.

10 Claims, 24 Drawing Sheets

(56) References Cited

U.S. PATENT DOCUMENTS

| | | | | |
|---|---|---|---|---|
| 4,756,110 | A | 7/1988 | Beltron | |
| 4,821,442 | A * | 4/1989 | Bock | F41A 9/72 42/17 |
| 4,905,395 | A | 3/1990 | Wagner | |
| 4,940,135 | A | 7/1990 | Hall | |
| 4,953,316 | A | 9/1990 | Litton, Sr. et al. | |
| 5,054,221 | A * | 10/1991 | Ozols | F41A 17/38 42/17 |
| 5,119,575 | A | 6/1992 | Gajdica | |
| 5,367,810 | A * | 11/1994 | Stead | F41A 9/72 42/17 |
| 5,452,533 | A | 9/1995 | Bentley | |
| 5,533,291 | A | 7/1996 | Boland | |
| 6,253,481 | B1 | 7/2001 | Melby | |
| 6,427,372 | B1 | 8/2002 | Howard et al. | |
| 6,490,958 | B1 | 12/2002 | Charest et al. | |
| 6,532,947 | B1 | 3/2003 | Rosa et al. | |
| 6,655,069 | B2 | 12/2003 | Kim | |
| 6,877,265 | B2 * | 4/2005 | Hajjar | F41A 9/68 42/19 |
| 7,225,574 | B2 | 6/2007 | Crandall et al. | |
| 7,380,361 | B2 | 6/2008 | Hajjar et al. | |
| 7,752,795 | B1 | 7/2010 | Medvedeo | |
| 7,779,571 | B1 | 8/2010 | Roth | |
| 7,810,271 | B2 | 10/2010 | Patel | |
| 7,866,079 | B2 | 1/2011 | Keeney et al. | |
| 7,963,061 | B2 | 6/2011 | Lesenfants | |
| 7,963,062 | B1 | 6/2011 | Rothaermel et al. | |
| 8,056,280 | B2 | 11/2011 | Lesenfants et al. | |
| 8,122,635 | B2 | 2/2012 | Pullicar | |
| 8,156,675 | B2 | 4/2012 | Heath | |
| 8,307,575 | B1 | 11/2012 | Battaglia | |
| 8,353,123 | B2 | 1/2013 | Pullicar et al. | |
| 8,418,390 | B1 | 4/2013 | Wright | |
| 8,484,875 | B2 | 7/2013 | Heath | |
| 9,015,979 | B2 * | 4/2015 | Safewright, Jr. | F41A 9/71 42/49.01 |
| 2005/0217160 | A1 | 10/2005 | Kaewpinyo | |
| 2011/0225864 | A1 * | 9/2011 | Pullicar | F41A 9/72 42/71.01 |
| 2012/0198743 | A1 | 8/2012 | Bentley et al. | |
| 2012/0204712 | A1 | 8/2012 | Hauck | |
| 2012/0304520 | A1 | 12/2012 | Battaglia | |
| 2013/0047831 | A1 | 2/2013 | Dejong | |
| 2013/0081314 | A1 | 4/2013 | Hatfield | |
| 2013/0125439 | A1 | 5/2013 | Bentley et al. | |
| 2013/0174456 | A1 * | 7/2013 | Ricks | F41A 9/18 42/6 |
| 2014/0250751 | A1 * | 9/2014 | Foster | F41A 9/55 42/6 |

FOREIGN PATENT DOCUMENTS

| | | |
|---|---|---|
| GB | 142404 | 5/1920 |
| WO | 9118255 | 11/1991 |
| WO | 2005015113 | 1/2005 |

* cited by examiner

REMOVABLE SHOTGUN MAGAZINE

CROSS-REFERENCE TO RELATED APPLICATIONS

The present application claims the benefit of priority to U.S. Provisional Application No. 61/883,633 filed Sep. 27, 2013, the entirety of which is incorporated herein by reference.

BACKGROUND OF THE. INVENTION

The present invention generally relates to shotguns or rifles, and more particularly to a removable magazine capable of being preloaded with shells before mounting in the shotgun or rifle.

Various type of arrangements are used for storing and feeding shot shells into the chamber of a shotgun or rifle. Some shotguns have integral permanently or semi-permanently affixed non-removable magazines that hold the shells in end-to-end relationship. Such magazines are manually loaded in place and not intended to be removed for reloading during normal use of the firearm. In both manual pump action and inertia/gas-driven auto-loading feed mechanisms, the shells are fed rearwards from the magazine towards an open action or breech. From there, the shells are loaded into the chamber at the rear of the barrel and the breech is closed and readied for firing via a trigger-actuated fire control mechanism. After firing, the spent shells am extracted from the chamber and ejected through an external port from the reopened breech. A fresh shell may now be loaded in the foregoing manner.

The foregoing permanently affixed magazines require shells to be manna loaded one at time into the magazine. This may be a cumbersome and time consuming reloading process, especially in exigent circumstances when the ability to quickly reload is of utmost importance. Although removable box style magazines having vertically stacked shells have been used, these magazine protrude downwards from the receiver of the shotgun which some users may find cumbersome.

An improved removable firearm magazine is desired.

SUMMARY OF THE INVENTION

Exemplary embodiments of the present invention provide an easily removable and detachable magazine for a firearm such as a shotgun or rifle. The removable magazine holds a plurality of shells in horizontal end-to-end relationship and generally operates in the same manner as horizontal permanently affixed magazines but with the convenience of removability. The magazine may be preloaded with ammunition shells outside of the shotgun and then removably inserted into a complementary configured magazine housing on the shotgun. Fully loaded spare magazines may therefore be carried which can be speedily exchanged with an empty magazine, thereby quickly readying the shotgun for firing again in a short period of time. The user therefore need not manually fumble with loading individual shells into the shotgun in the field, which is especially beneficial in exigent circumstances.

Advantageously, embodiments of the present removable magazine also provide tool-less removal and installation of magazines from the shotgun which further expedites the shell reloading process. The present removable magazine may be used with both manual pump-action and inertia/gas driven shell feeding systems employed in shotguns. The present removable magazine may also be used for storing and feeding rimfire or centerfire cartridges into a shotgun or rifle. Embodiments of the present invention also allow individual shells to be loaded manually into the shotgun or rifle if desired.

In one embodiment, a firearm with removable magazine includes a receiver including, a trigger-actuated firing mechanism, a barrel coupled to the receiver and defining a longitudinal axis, an outer magazine housing coupled to the receiver and defining an elongated internal cavity, and an inner tubular magazine slideably and removably inserted in the housing. The magazine housing may have a tubular or other shape in various embodiments. The tubular magazine defines a longitudinally extending internal open cavity with circular cross section configured for holding a plurality of shells in horizontally stacked end-to-end axial relationship. In one embodiment, the magazine is insertable into and removable from an open front end of the magazine housing. When the magazine is positioned in the housing on the shotgun, the internal cavity of the magazine is in communication with an openable and closeable breech defined in the receiver at the rear of the barrel. This allows shells to be fed from the magazine into an open breech and loaded into the barrel by the action for firing.

According to one aspect, a magazine assembly for a firearm includes an outer magazine housing configured for attachment to a firearm having a longitudinal axis defining an axial direction, and an elongated magazine removably insertable into the housing. The magazine includes an open rear end and axially extending internal cavity configured to hold a plurality of shells in stacked end-to-end relationship. A shell catch lever is slideably mounted at the rear end of the magazine for linear movement parallel to the longitudinal axis. The shell catch lever is configured to retain the shells in the magazine in a first lateral position and release the shells from the magazine in a second lateral position. The shell catch lever is configured and operable to retain and release the shells when removed from the magazine housing to allow the magazine to be preloaded before insertion into the housing. In some embodiments, the shell catch lever is further configured for lateral movement transverse to the longitudinal axis when moved from the first to second lateral positions.

The shell catch lever is laterally displaceable with respect to the magazine to move from the first to second lateral positions by sliding the shell catch lever in a forward axial direction. In one embodiment, the shell catch lever includes an inclined surface which slideably engages a mating, inclined surface on the magazine, the engaged inclined surfaces translating linear movement of the shell catch lever into the lateral movement. In some embodiments, the shell catch lever is also pivotably mounted on the magazine for lateral movement transverse to the longitudinal axis between the first and second lateral positions by rotating the shell catch lever. In some embodiments, the shell catch lever includes a pitiless pivot that engages the magazine to form the pivotable mount.

According to another aspect, a firearm with removable tubular magazine includes: a longitudinal axis defining an axial direction; a receiver; a barrel coupled to the receiver and defining a chamber for holding a shell; an outer magazine housing coupled to the receiver; an elongated tubular magazine removably inserted in the housing, the magazine including an internal cavity configured to hold a stack of shells in end-to-end relationship; and an elongated shell catch lever mounted proximate to an open rear end of the magazine. The shell catch lever is laterally movable between an inward closed position for retaining the shells in the magazine and an outward open position for dispensing the shells from the magazine. The shell catch lever in a first operating; mode is slidable in the axial direction to move from the closed position to the open position. The shell catch lever in a second operating mode is also pivotable moveable in a transverse direction to move from the first position to the second position.

A method for loading ammunition into a firearm is provided. In one embodiment, the method includes steps of: providing a magazine having a tubular body configured to hold a stack of shells arranged in end-to-end relationship and a biasing member for urging the stack rearwards toward an open end of the magazine; the magazine including a shell catch lever configured and arranged to engage a rearmost shell in the stack when loaded into the magazine, the shell catch lever being spring-biased into an inward closed position for retaining the shells in the magazine and laterally movable to an outward open position for dispensing the shells from the magazine; loading the stack of shells into the magazine, the shell catch lever being moved to the open position during loading the stack of shells into the magazine; moving the shell catch lever to the closed position; placing a shell release lever mounted on the firearm in a deactivated position; axially inserting the loaded magazine into an elongated outer housing, attached to the firearm; engaging the shell catch lever with the shell release lever by moving the shell release lever to an activated position; and moving the shell catch lever on the magazine to the open position by engagement with the shell release lever, wherein the rearmost shell in the magazine is released by the shell catch lever for dispensing to the firearm.

BRIEF DESCRIPTION OF THE DRAWINGS

The features of the exemplary embodiments will be described with reference to the following drawings where like elements are labeled similarly, and in which:

All drawing shown herein are schematic and not necessarily to scale. A general reference to a drawing number (e.g. FIG. 9) that contains multiple subpart figures (e.g. FIG. 9A, 9B, etc.) shall be construed as a reference to all subparts unless specifically noted otherwise.

DETAILED DESCRIPTION OF THE INVENTION

Figure 1:
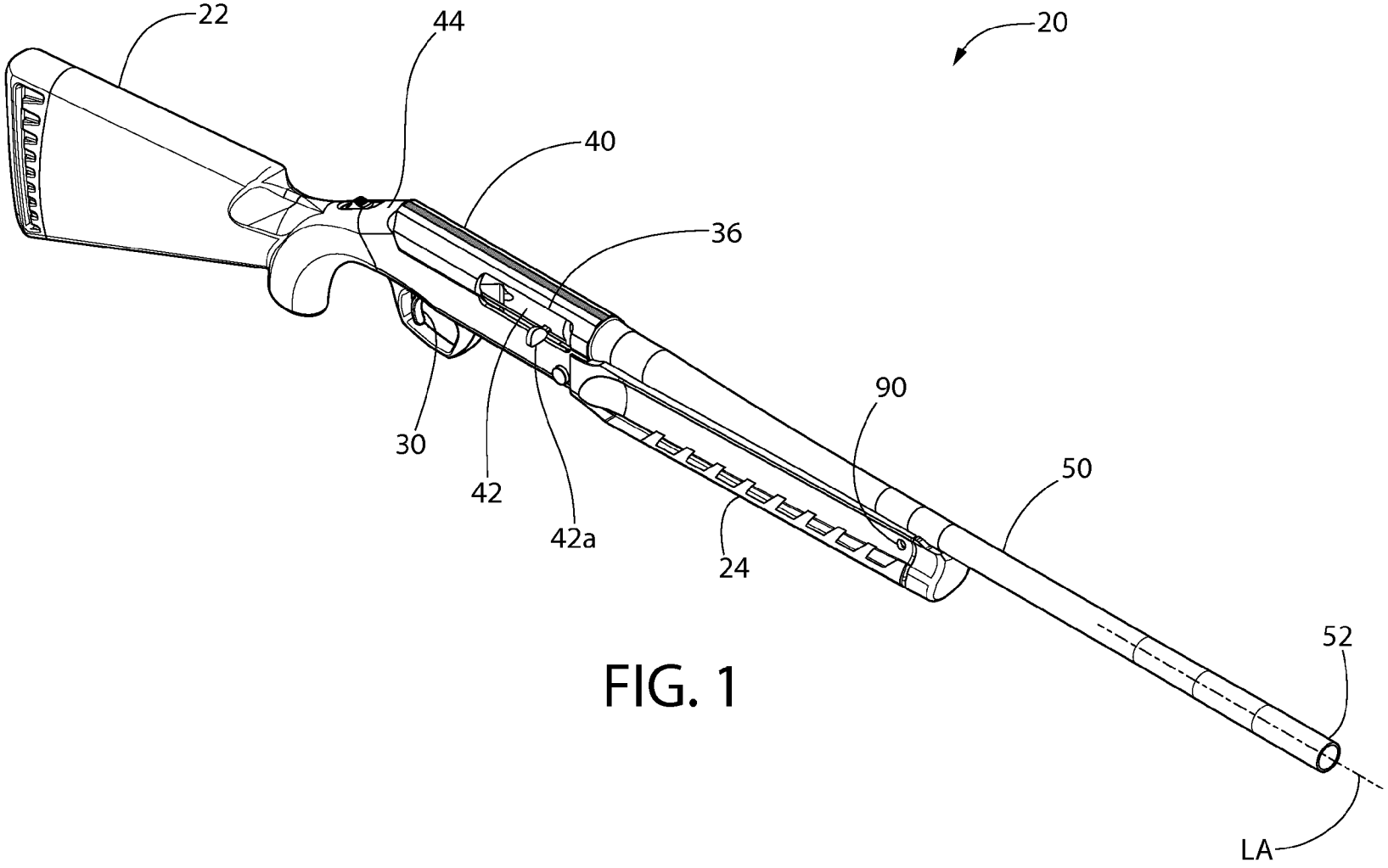
FIG. 1 is a right perspective view of one exemplary embodiment of a firearm including a removable tubular magazine.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation.

Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

The term "action" is used herein in its conventional sense in the firearm art to connote the mechanism that loads and ejects shells into/from the firearm and opens and closes the breech (i.e. the area in the receiver between an openable/closeable breech face on the front of the bolt and the rear face of barrel chamber).

An exemplary firearm incorporating an embodiment of a magazine according to principles of the present invention will now be described for convenience with reference to a shotgun. The principles and features of the embodiments disclosed herein, however, may be embodied with equal benefit in other types of firearms such as rifles. Accordingly, the invention is expressly not limited in its applicability or scope to shotguns alone as described herein with respect to one possible non-limiting embodiment, it will further be appreciated that the present magazine may be used with shotgun shells and/or rimfire or centerfire cartridges where it is desired to store and feed such ammunition from a horizontally stacked end-to-end relationship.

FIGS. 1-3 and 16-20 illustrate an exemplary shotgun including a removable magazine according to the present disclosure. The shotgun 20 generally includes a stock 22 (aka buttstock), forearm 24, receiver 40, trigger-actuated firing mechanism 31 including a trigger 30 supported by the receiver, and a barrel 50. The receiver 40 includes a lower receiver 48 that pivotally supports the trigger and an upper receiver 49 axially aligned with and supporting, the barrel 50 (see also FIGS. 19-20). In one embodiment, barrel 50 may be threadably coupled to the receiver 40.

The receiver 40 forms an internally open receptacle that houses the firing mechanism components, which may include a locking bolt 42 defining a breech face 43 on a front end, a spring-biased striker or firing, pin 41 carried by the bolt for detonating a chambered ammunition shell 60, a pivotable hammer 31 spring biased by a hammer-spring strut assembly 34, sear 35 operable to hold and release the hammer from a cocked position, pivotable carrier 32 mounted via a transverse pivot pin 33 to the receiver, and other parts and linkages to form a fully functional firing and shell loading system. Bolt 42 may include a bolt handle 42*a* to manually cycle the action. The stock 22 may be attached to a rear extension 44 of the receiver 40 such as via a stock bolt (see FIG. 18) or other method. The forearm 24 may be supported by the barrel 50 and front end 45 of the receiver 40. The stock 22 and forearm 24 may be made of natural materials e.g. wood) and/or synthetic materials (e.g. plastic, fiberglass, carbon-graphite composites, etc).

The barrel 50 has an open rear breech end. 51 defining, a chamber 53 configured for holding an ammunition shell and an opposite open muzzle end 52. The area rear of the shell chamber 53 defines an openable/closeable breech in conjunction with the axially movable bolt 42. The barrel 50 has an axially extending bore 54 forming a projectile pathway between the barrel ends thereby defining a longitudinal axis LA and corresponding axial direction. The barrel 50 may be coupled to the front end 45 of the receiver 40 at the upper receiver 49 in axial alignment with the bolt 42 and firing pin 41. In one embodiment, barrel 50 may be threadably attached to the receiver 40.

Figure 3:
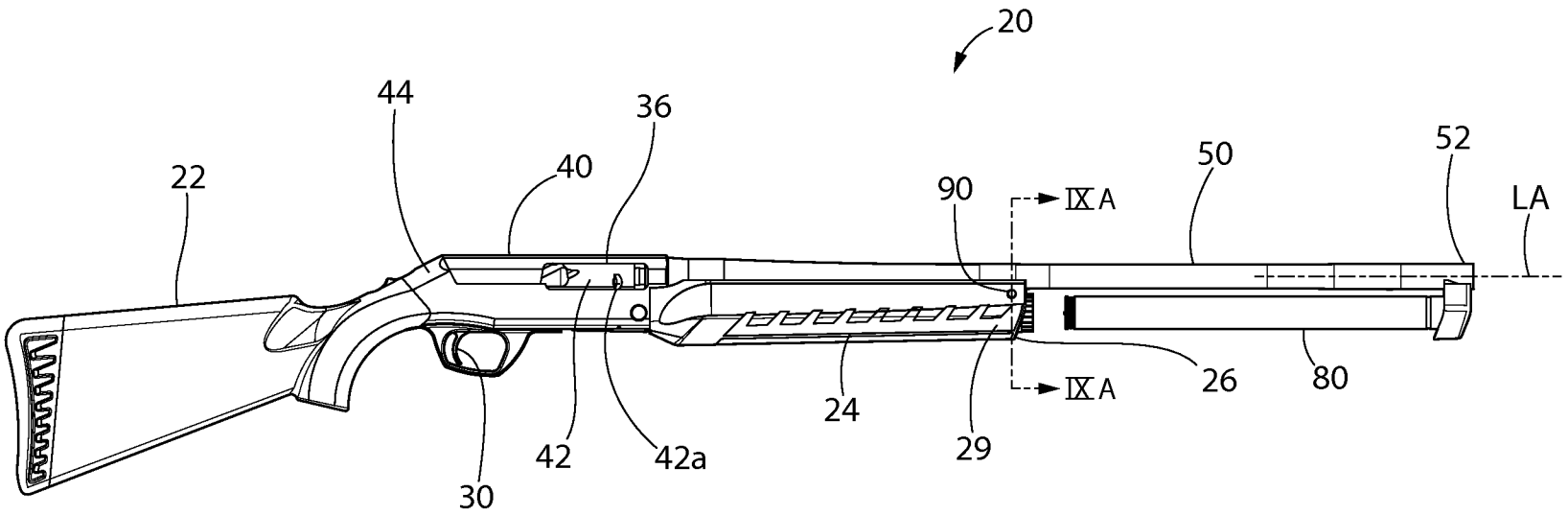
FIG. 3 is right side elevation view thereof.
Figure 4:
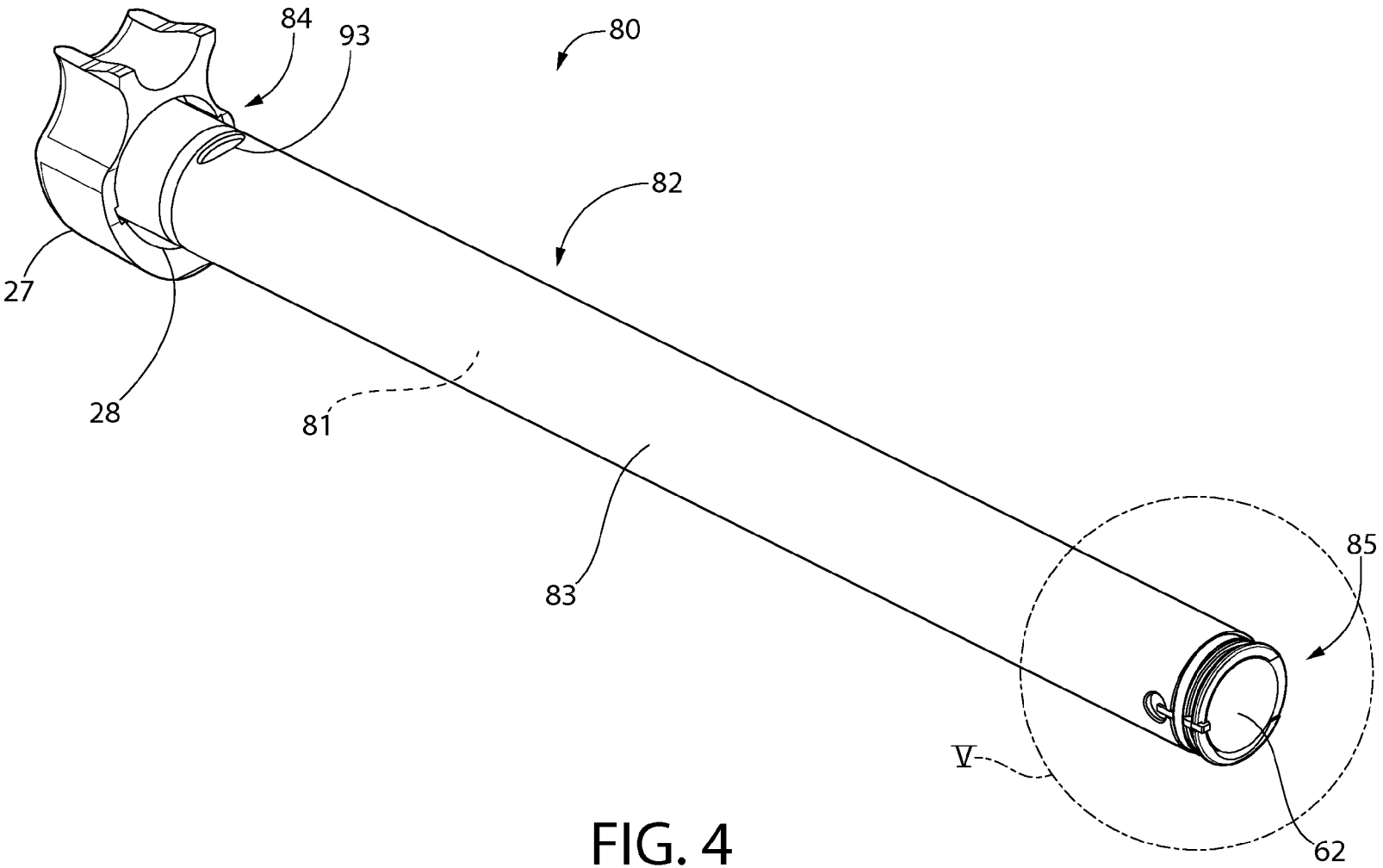
FIG. 4 is a perspective view of the magazine.
Figure 5:
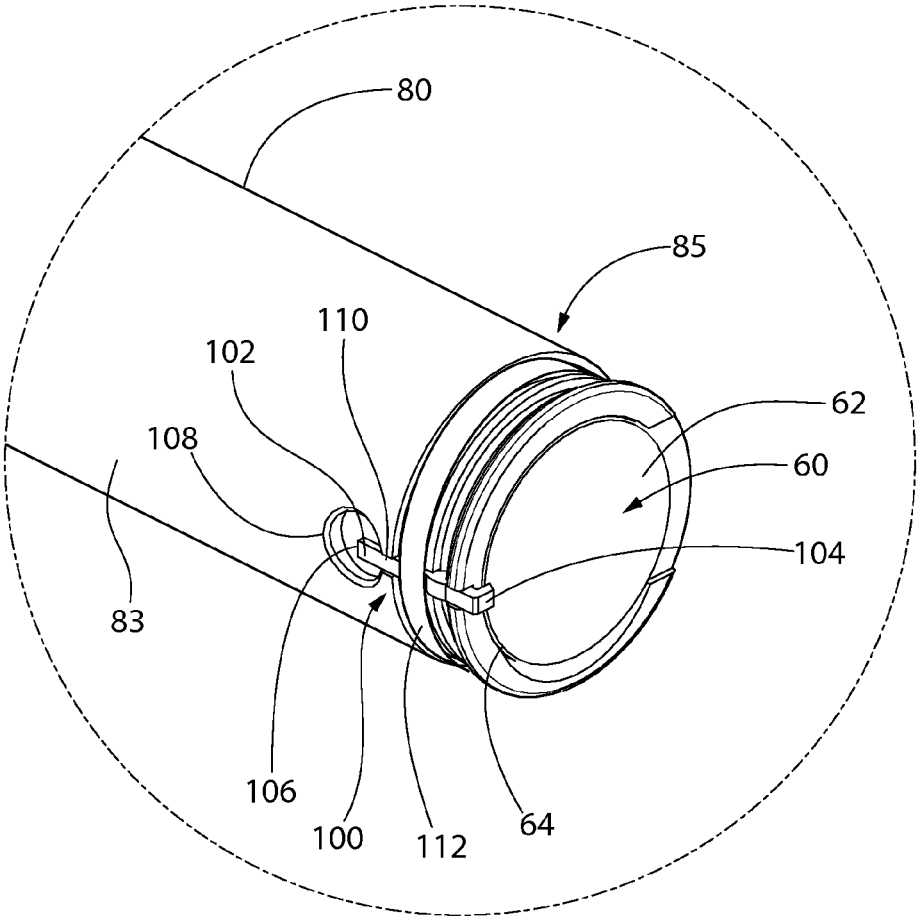
FIG. 5 is an enlarged detail taken from FIG. 4.
Figure 6:
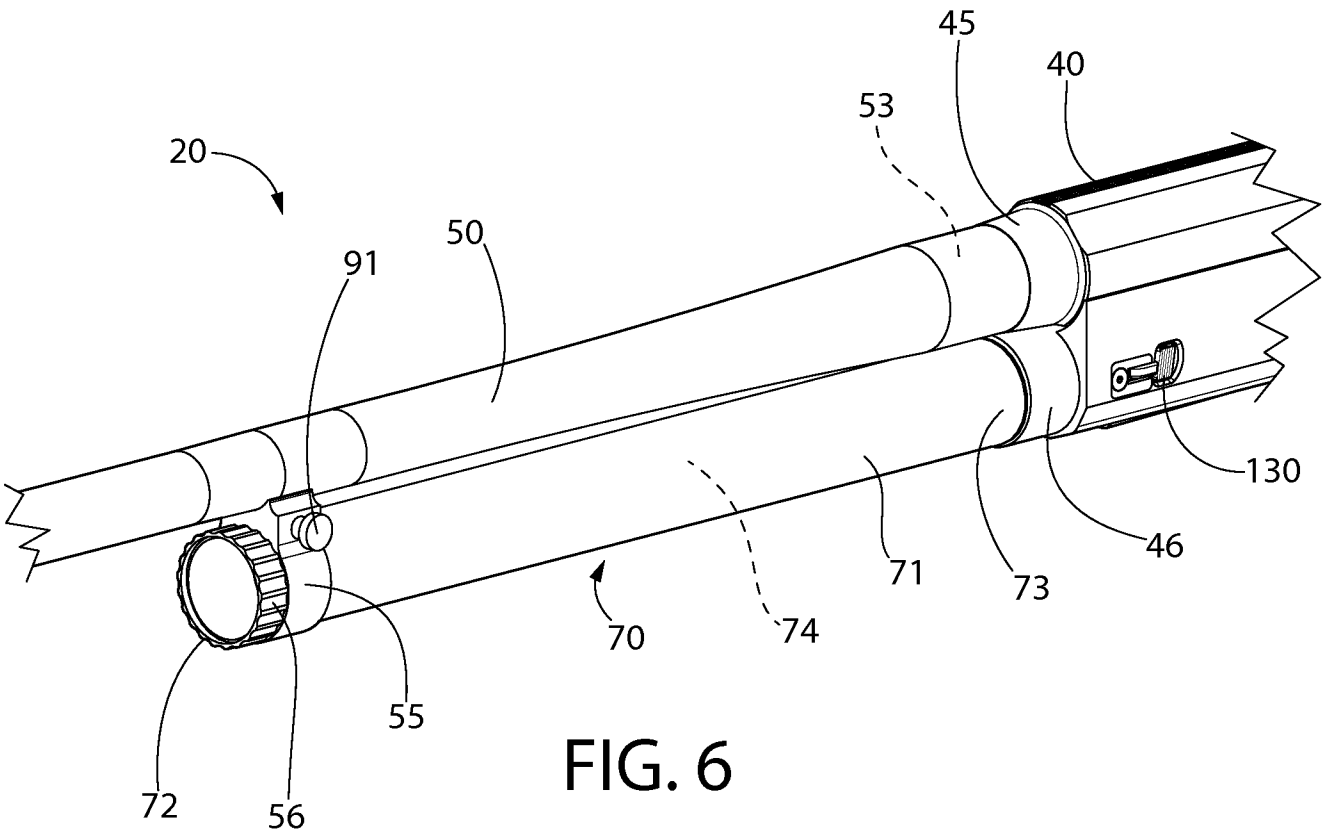
FIG. 6 is a left perspective view of the magazine housing, barrel, and receiver with the forearm not shown for clarity.
Figure 7:
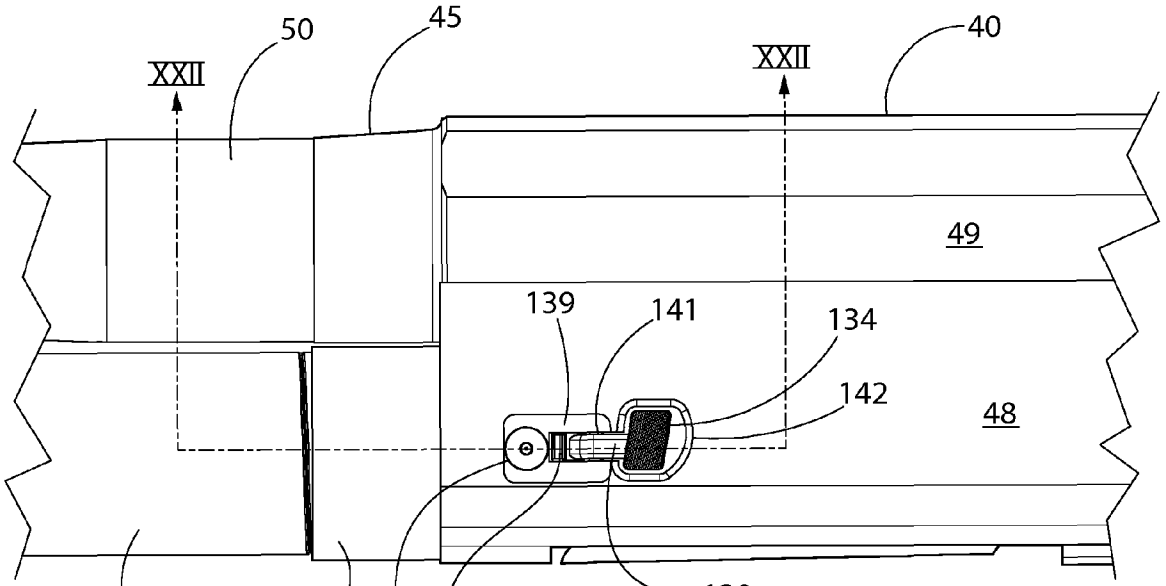
FIG. 7 is a left side elevation view of the firearm showing an accessible shell release lever.

FIGS. 4-6 illustrate one possible embodiment of a tubular magazine assembly for a shotgun including an outer magazine housing 70 and an inner removable tubular magazine 80. The inner tubular magazine 80 is configured and dimensioned to be removably and slideably insertable inside the outer magazine housing 70 (see also FIGS. 1-3). In one embodiment, the magazine housing 70 may have a tubular shape being comprised of cylindrical walls 71, an open front end 72, and open rear end 73. The magazine housing 70 serves a sleeve for holding the magazine 80. It should be noted that magazine housing 70 remains affixed to the shotgun 20 during operation and a magazine exchange, only the magazine 80 is removed from the shotgun.

The magazine housing 70 may be formed from an elongated metal tube in one embodiment which defines a longitudinally extending and circular shaped internal cavity 74 in transverse cross section sized to removably receive the magazine having a complementary configuration therein (see, e.g. FIG. SA). The magazine housing. 70 may be attached to and supported by the barrel 50 and lower receiver 48. In one embodiment, the rear end 73 of the magazine housing 70 tube may be plain and slideably inserted into a forwardly open socket 46 formed on the front end 45 of the lower receiver 48. The front end 72 of the magazine housing may be supported by an annular-shaped support ring 55 extending, downwardly from and affixed to the barrel 50. A front portion of the housing 70 tube near the front end 72 extends through the support ring 55 as best shown in FIG. 6. The front end 72 of the housing tube 70 may be externally threaded and is threadably engaged by an annular shaped nut 56. This slightly compresses the magazine housing 70 tube between the support ring 55 and the socket 46 on the receiver 40 to secure the housing in place on the shotgun 20, and keep the rear end 73 of the magazine housing tube inserted in and engaged with the socket. In alternative embodiments, the rear end 73 of the magazine housing 70 may have external threads 75 to threadably engage a threaded receiver socket 46 in lieu of a sliding slip fit (see, e.g. FIG. 14A). Other mounting arrangements and configurations are possible. It will be appreciated however that the magazine housing 80 is designed to remain intact on the shotgun 20 while the firearm remains operable, but may be removed periodically for maintenance purposes.

Figure 2:
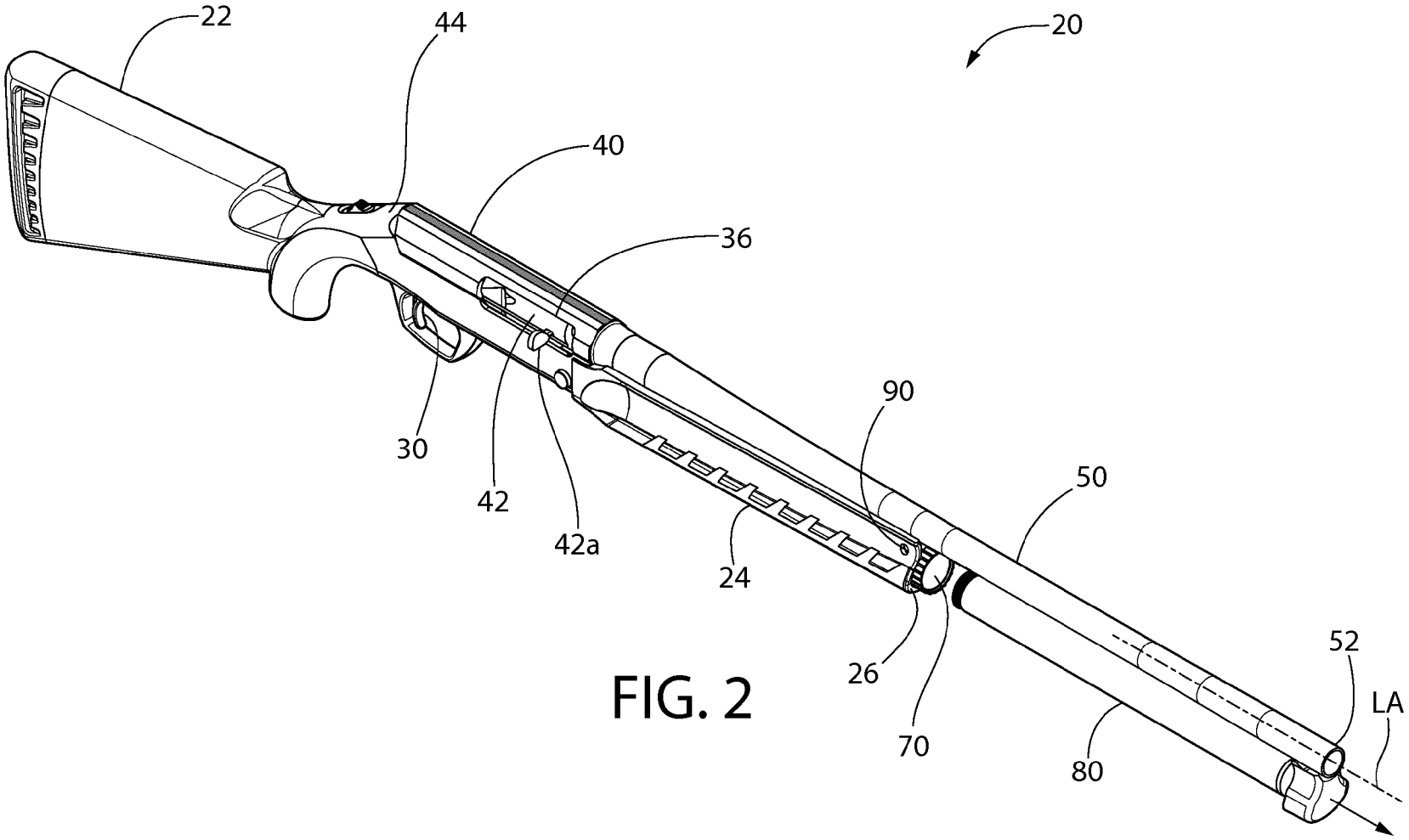
FIG. 2 is a partially exploded view thereof showing the magazine axially withdrawn from a magazine housing of the firearm.

The forearm 24 of the shotgun 20 has an a longitudinally extending open channel 25 which receives and encloses the magazine housing 70. Accordingly, the magazine housing 70 is substantially concealed and disposed inside the forearm. The channel 25 may be open at the top for mounting over the magazine housing 70 and be open at the front end 26 which allows the front end 72 of the tubular housing to protrude slightly forward from the forearm 24, as shown in FIG. 2. This allows the annular nut 56, which has a larger outside diameter than the magazine housing tube, to be positioned external to the forearm channel 25 thereby allowing the forearm to be as small as possible in cross-sectional profile for ease of grasping by the user.

Figure 8B:
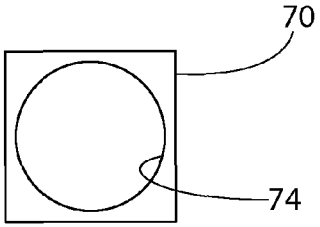
FIG. 8B is a transverse end view of an alternative configuration of a magazine.
Figure 8A:
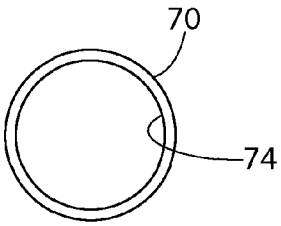
FIG. 8A is a transverse end view of one configuration of the magazine housing.

In other possible embodiments, the magazine housing 70 may have an open tubular shape other than circular in transverse cross section. Accordingly, the magazine housing may have a square, triangular, hexagonal, or other suitable shape forming longitudinally extending cavity 74 therein sized to removably and slideably receive the magazine 80 therein (see, e.g. FIG. 8B). Preferably, these alternative embodiments of a magazine housing have an internal cavity in cross section that closely approximates but is slightly larger than the outside diameter of the circular cross section of the magazine 80 to provide a relatively close fit to minimize lateral play.

Referring to FIGS. 1-5, the magazine 80 includes an elongated tubular body 82 (also referred to herein as "magazine tube") which may formed of a metal tube having cylindrical walls. In other embodiments, a non-metal tube may be used (e.g. plastic or other). The body 82 defines an outer surface 83, inner surface 88, and an axially extending internal cavity 81 configured and dimensioned to hold a plurality of shotgun shells in horizontally stacked end-to-end relationship. The tubular body 82 includes a closed front end 84 and an open rear end 85 for loading and dispensing shells 60. When mounted in the magazine housing 70, the rear end 85 may protrude axially outwards beyond the rear end 73 of the housing (see, e.g. FIGS. 10-13). A magazine spring 86 and follower 87 assembly is disposed inside the magazine tube. The spring 86 has a front end abutting the closed front end 84 of the magazine body and rear end engaging the follower 87. The spring 86 biases the follower 87 rearward for feeding the stack of shells 60 into the receiver 40.

In one embodiment, the front section of the forearm 24 may be removable and formed by an end cap 27 attached to the front end 84 of the magazine 80 tube. The forearm end cap 27 may be configured to have a complementary transverse cross sectional shape that substantially matches the cross-sectional shape of the forward fixed portion 29 of the forearm 24 adjoining the removable end cap. This creates an aesthetically pleasing appearance such that the end cap 27 visually is a continuation of the forearm when the magazine is fully mounted to the shotgun except for the presence of the transverse seam or line between the end cap and forearm (see, e.g. FIG. 1). Accordingly, a majority of the outer surfaces of the end cap 27 may be substantially flush with the adjoining forward fixed portion 29 of the forearm 24 as shown. In one embodiment, the end cap 27 abuttingly contacts the forward fixed portion 29 of the forearm 24.

The front end 84 of the magazine 80 tube is embedded in the forearm end cap 27 and concealed from view of a user (see, e.g. FIG. 4). Accordingly, in one embodiment the from end 84 of the magazine tube does not penetrate through the end cap 27. Embodiments of the end cap 27 may further include a rearwardly open enlarged annular-Shaped recess 28 formed between the front end 84 of the tubular magazine body 82 and the inside walls of the cap for insertably receiving annular nut 72 of the magazine housing. 70 therein (see, e.g. FIG. 9D). This allows the end cap 27 to be located rearward as for as possible against the forward fixed portion of the forearm to minimize any visible gaps therebetween for aesthetics. The forearm end cap 27 may be made of the same material as the forearm 24 to give a uniform appearance to the assembly.

Advantageously, by matching the end cap configuration to the forearm forward fixed portion 29 of the shotgun 20, the user may be assisted with inserting, the removable magazine 80 in the proper rotational position in the magazine housing 70 to align the rear shell latching mechanism of the magazine with a corresponding operating area of the receiver, as further described herein, it should further be noted that the end cap 27 also serves to limit the insertion depth or length of the magazine 80 into the outer magazine housing 70 to properly position the latching mechanism at the proper axial position with respect to the receiver 40.

In other possible embodiments, the front section of the forearm 24 may not be removable and remains an integral part of the unitary forearm structure. In this construction, a frontal opening may be made in the front end of the forearm 24 to receive the inner magazine 80 tube for insertion into the outer magazine housing. 70 disposed inside the forearm on the shotgun. In some arrangements, the front end 84 of the magazine tubular body 82 may project forward beyond the front end of the forearm for grasping by a user to facilitate removing the magazine. It will be appreciated that numerous variations in the arrangement and configuration of the magazine and forearm are possible. Accordingly, the invention is therefore not limited to the examples described herein.

The magazine 80 further includes a magazine release formed by a locking mechanism 90 for releasably securing the magazine in the magazine housing 70 fixed on the shotgun. In one embodiment, the locking mechanism 90 may be disposed proximate to the front end of the magazine. Referring to FIGS. 4 and 9A-F, the locking mechanism 90 may comprise of a laterally movable lock pin 91 which alternatingly engages a frontal blocking surface formed in an oblong locking cutout 93 formed in the top surface of the tubular magazine body 82. In one embodiment, cutout 93 may be disposed proximate to the front end 84 of the magazine. Lock pin 91 is slideably received in a transversely oriented and open passage 92 formed through the magazine housing support ring 55 and forearm 24 beneath the barrel 50 (see also FIGS. 1-3). Passage 92 extends laterally through each side of the ring 55 and forearm 24 as shown in a direction perpendicular to the longitudinal axis LA. The portion of the passageway 92 formed through the sidewalk of the ring 55 support each end 96*a*, 96*b* of the lock pin 91.

Figure 9A:
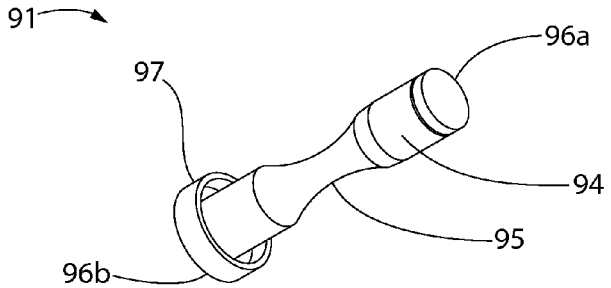
FIG. 9A is a perspective view of a lock pin used for releasably securing the magazine in the magazine housing and firearm.

Elongated lock pin 91 includes a concave recess 95 formed at least on the underside of the pin as best shown in FIG. 9A. In one embodiment, the recess 95 may be formed on a reduced diameter central portion of pin 91 disposed between ends 96*a*, 96*b*. A blocking surface 94 is formed on at least one lateral side of the concave recess 95 by the full diameter portion of the pin adjacent the ends 96*a* or 96*b*. A diametrically enlarged operating head 97 is formed on one end 96*a* or 96*b* of the lock pin 91 for pushing by a user to actuate the locking mechanism 90.

Figure 9B:
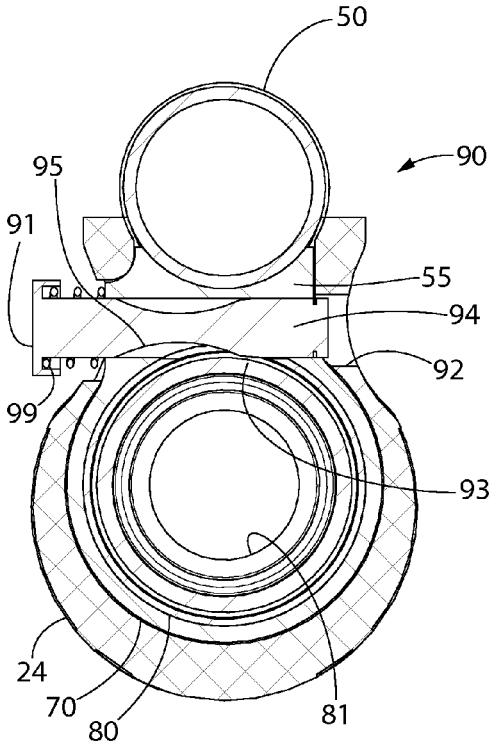
FIG. 9B is a cross sectional view of a locking mechanism using the lock pin showing a locked position.
Figure 9C:
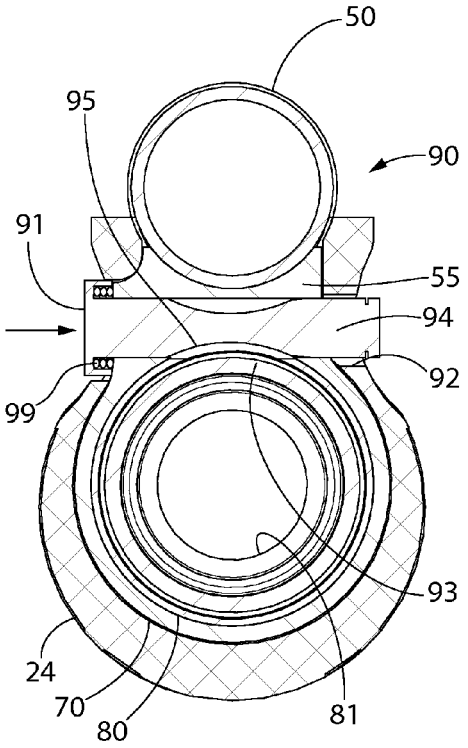
FIG. 9C is a cross sectional view of the locking mechanism showing the unlocked position.
Figure 9D:
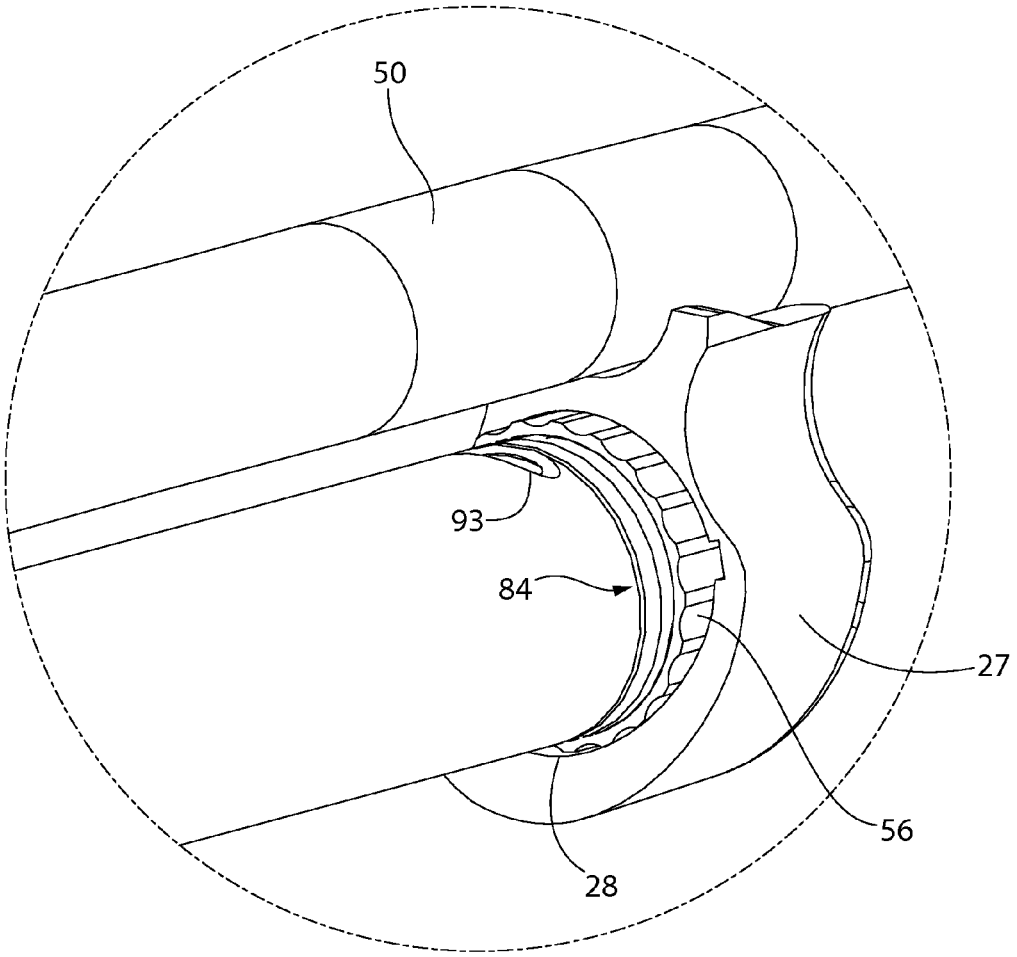
FIG. 9D is an enlarged perspective view of the front end of the magazine showing a locking cut out which interacts with the lock pin to lock or unlock the magazine from the firearm.
Figure 9E:
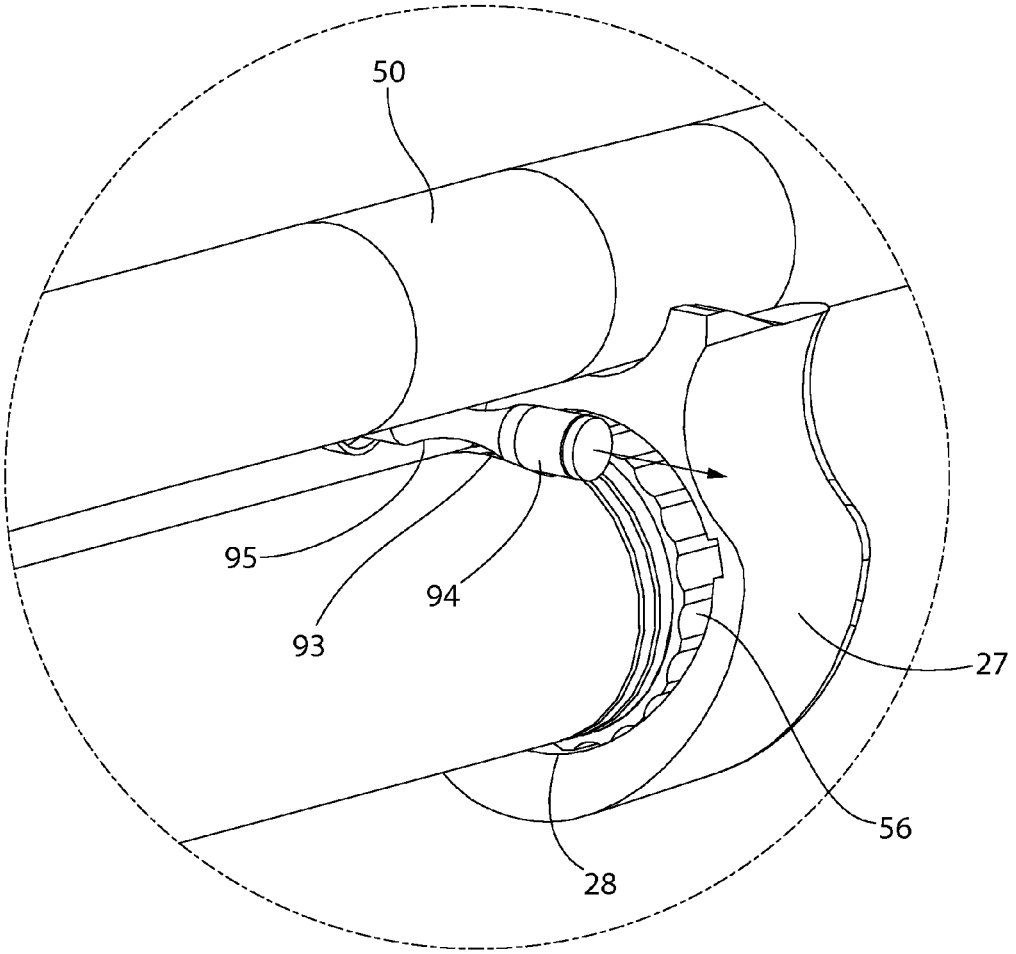
FIG. 9E is an enlarged perspective view thereof showing the lock pin in the locked position.
Figure 9F:
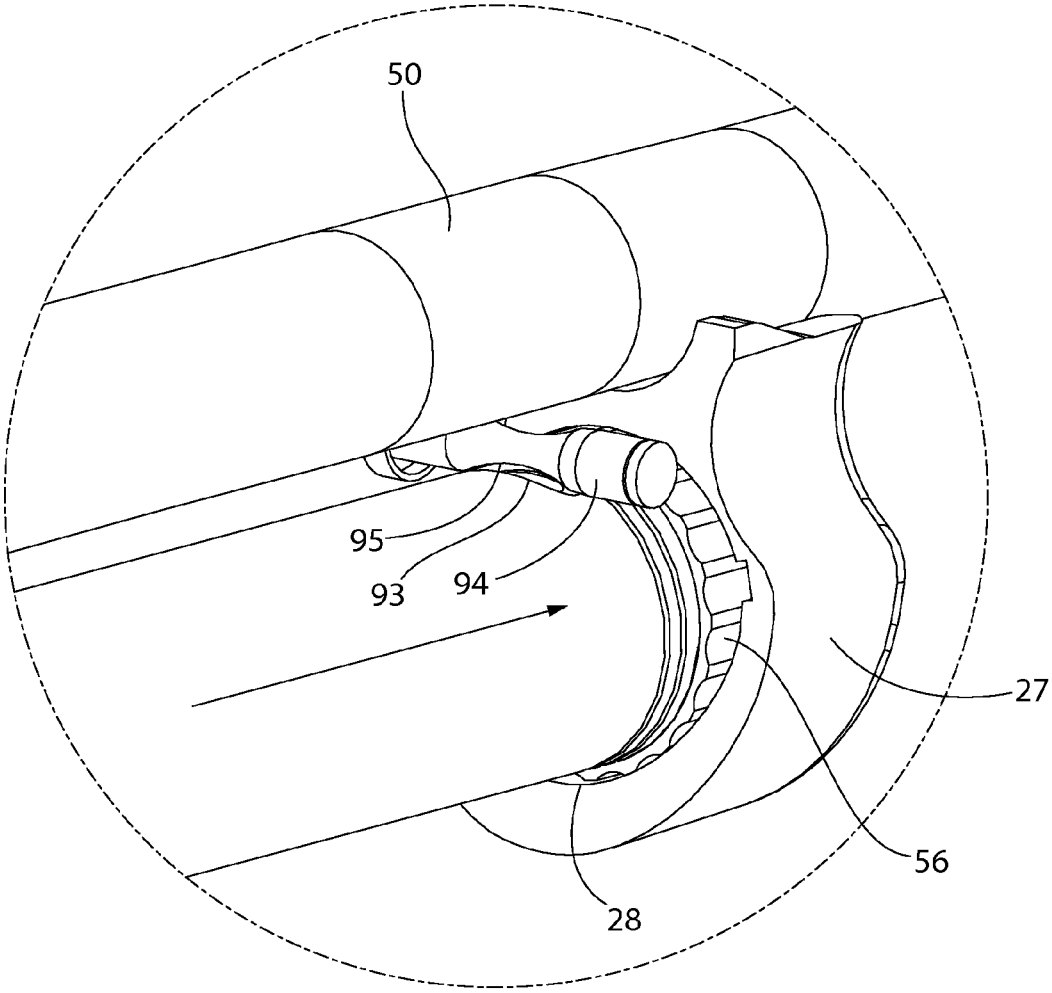
FIG. 9F is an enlarged perspective view thereof showing the lock pin in the unlocked position.
Figure 10:
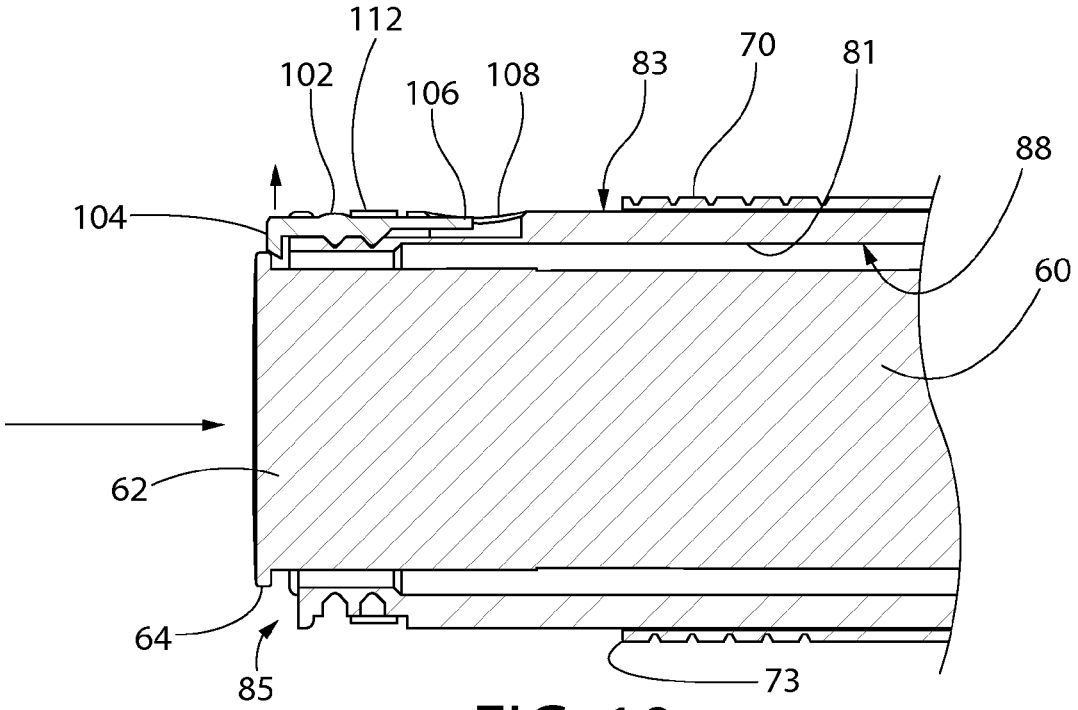
FIG. 10 is a longitudinal side cross sectional view showing a shell catch lever of the magazine moving towards a laterally displaced and outward open position for loading or dispensing shells into/from the magazine.

Lock pin 91 is laterally movable and projectable through each open side of the passageway 92 between a locked position shown in FIGS. 9B&E and a unlocked position shown in FIGS. 9C&F. In the locked position wherein the magazine 80 is retained in the magazine housing 70, the blocking surface 94 is at least partially inserted into locking cutout 93 forming a blocking relationship to prevent axial forward withdrawal and removal of the magazine from the magazine housing 70 and shotgun 20. In the unlocked position, the blocking surface 94 is removed from cutout 93 and the concave recess 95 is axially aligned with the tubular body 82 of the magazine 80. This positioning allows the arcuate top surface of the magazine body 82 to slide forward and pass through recess 95 beneath the lock pin 91, thereby allowing the magazine 80 to be axially withdrawn and removed from the shotgun 20. In operation of the embodiment shown, the user pushes the lock pin 91 either towards the right or left of the shotgun to unlock or lock the magazine 80, respectively (see directional arrow). A spring 99, such as without limitation a compression spring, or other type, may be provided that biases the lock pin 90 towards the locked position by engaging a recess formed in the underside (inner) of the lock pin operating head 97 as shown in FIGS. 9B-C.

As shown in FIGS. 4.5 and 10-16, the rear end 85 of the magazine 80 includes a shell catch 100 which retains the shells 60 in the magazine when either outside of or positioned in the shotgun 20. This prevents the shells from being ejected by the rearward biasing force of the spring 86 and follower 87. The shell catch 100 further functions to release shells 60 when either outside of or positioned in the shotgun 20. In one embodiment, the shell catch 100 may be configured as a lever 102 that is both pivotally and slideably mounted on a lateral side of the magazine tube adjacent the rear end. 85 of the magazine 80. In this embodiment, the shell catch lever 102 has a dual operation capability being configured and operable to load and release shells from the magazine by both a pivoting lever action or an axially sliding lever action, as further described herein.

Figure 14A:
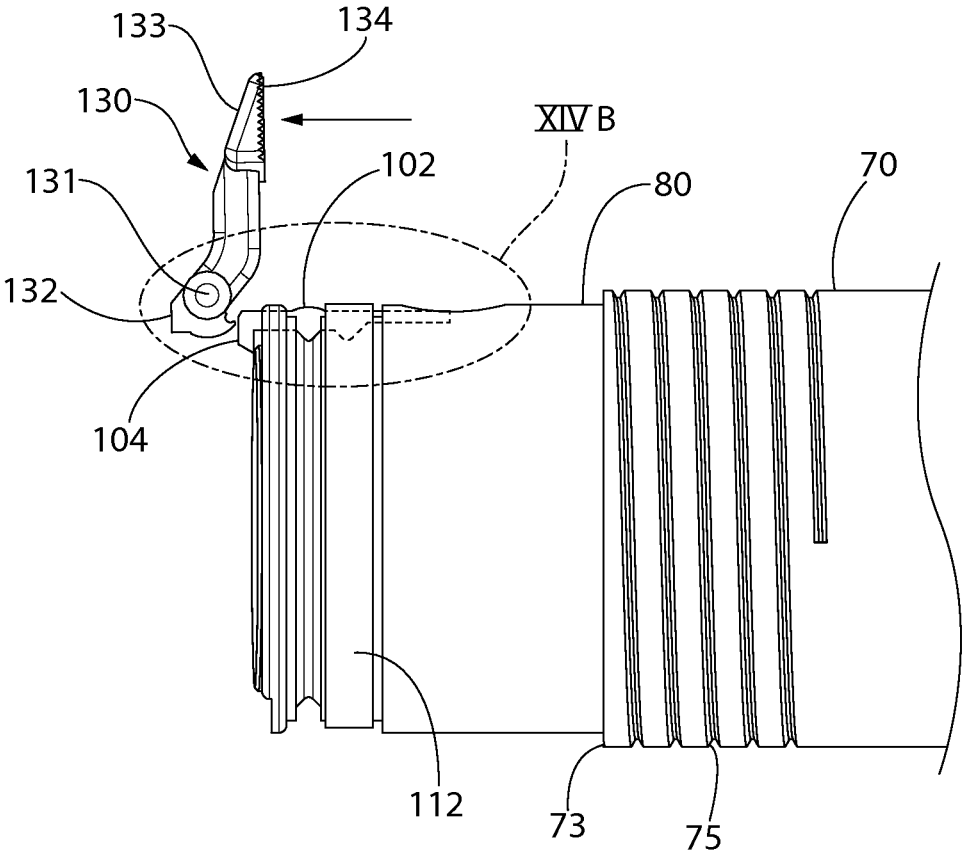
FIG. 14A is a side elevation view of the rear end of the magazine showing a shell release lever in outward deactivated position.
Figure 14B:
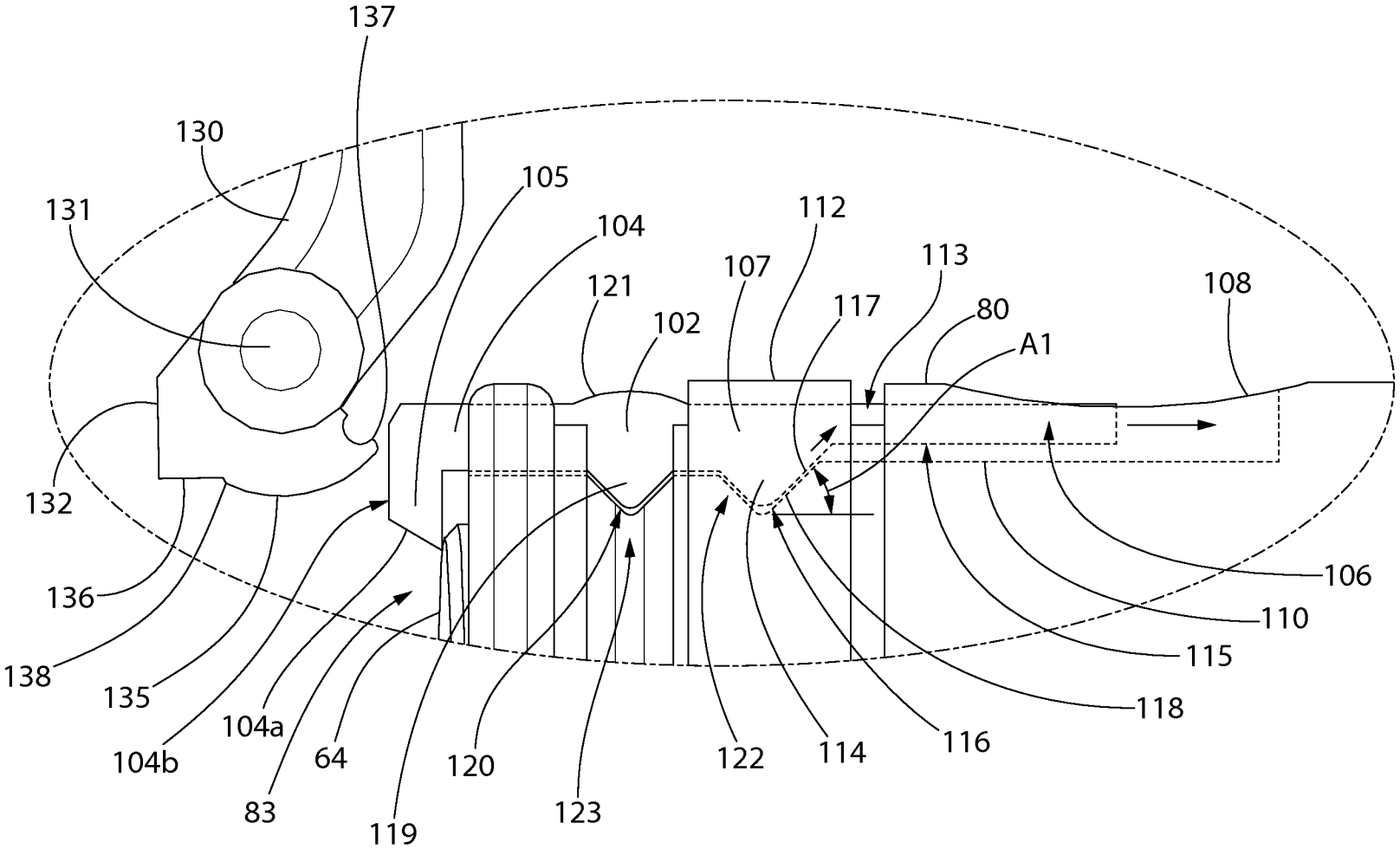
FIG. 14B is an enlarged view from FIG. 14A.

The shell catch lever 102 has an axially elongated body 107 defining an outer surface 113 facing away from the magazine body 82 and an opposite inner surface 115 facing towards the magazine body (inner and outer being defined in reference to position of lever when mounted on magazine 80 as best shown in enlarged view FIG. 14B). Catch lever 102 includes a first hooked end 104 at rear configured to catch and engage the metallic head 62 of a shell 60 (e.g. rim or flange 64) typically formed from brass and an opposite operating end 104 at the front. The hooked end 102 in one embodiment may comprise an L-shape configuration having an inwardly extending arm 105 disposed at an angle to the body 107. The angle may be between 0 and 180 degrees, and preferably 90 degrees in one non-limiting embodiment.

The operating end 104 is disposed adjacent to or partially inside an operating window 108 formed in a lateral side of the magazine body 82. Operating end is laterally movable and projectable inwardly and outwardly in the window 108. An axial slot 110 may be formed which extends rearwards from and penetrates the window 108. The slot 110 is axially aligned with the catch lever 102. This provides clearance for the forward portion of the shell catch lever 102 containing the operating end 106 disposed in the slot 110 to allow both axial and lateral movement of end 106 into and out of the window through the magazine tube wall. A triangular pivot 114 is formed between the hooked and operating ends 104, 106 to provide a sort of "see-saw" action to the catch lever 102 such that pivoting the operating end 106 laterally inwards moves the hooked end 102 in an opposite laterally outwards direction, and vice-versa as further described herein.

Figure 11:
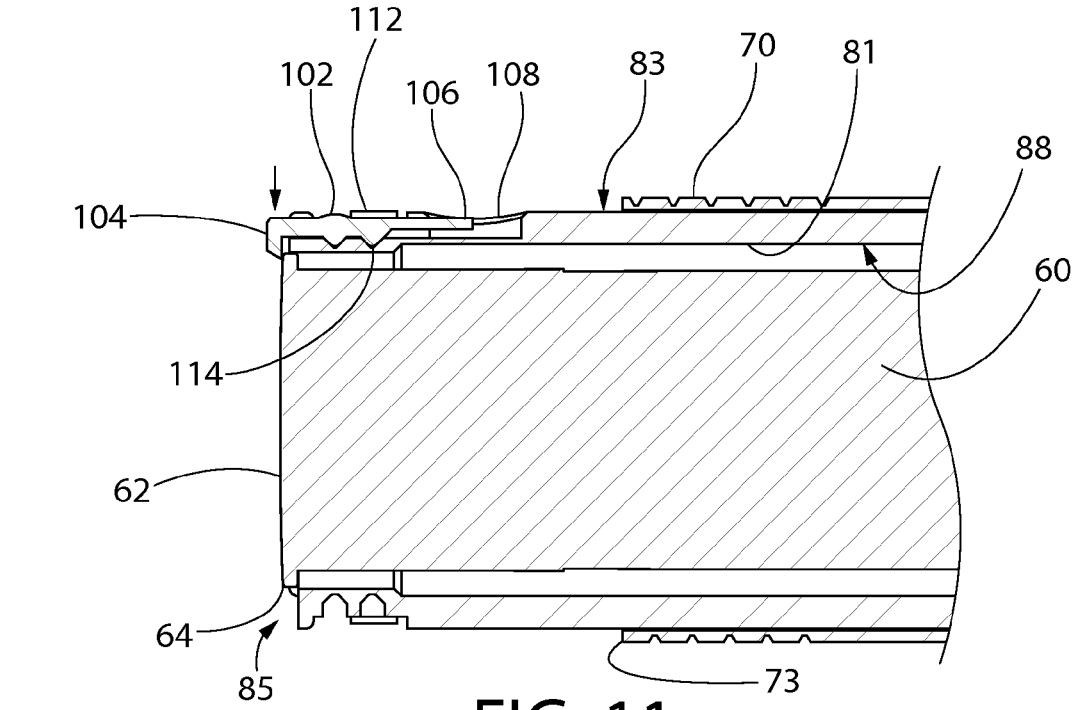
FIG. 11 is a longitudinal side cross sectional view thereof showing a shell catch lever of the magazine moving returning to an inward closed position for engaging and retaining the shells in the magazine.
Figure 12:
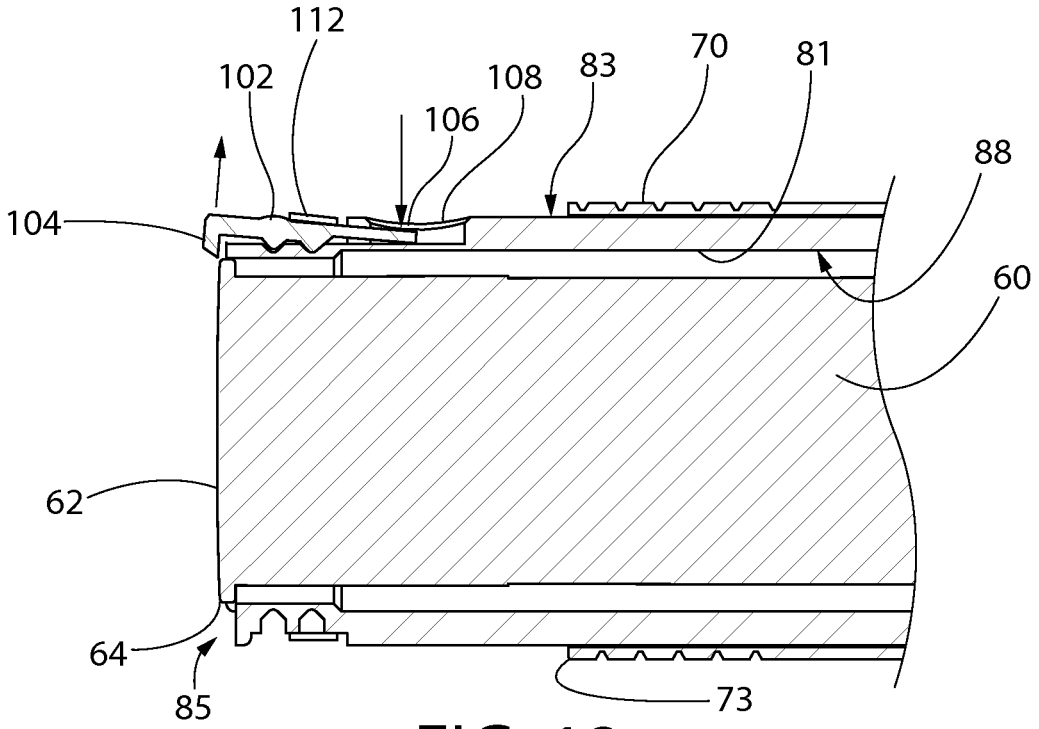
FIG. 12 is a longitudinal side cross sectional view thereof showing a front operating end of the shell catch lever being displaced inward which pivots the rear hooked end of the lever laterally outwards to disengage a shell.
Figure 13:
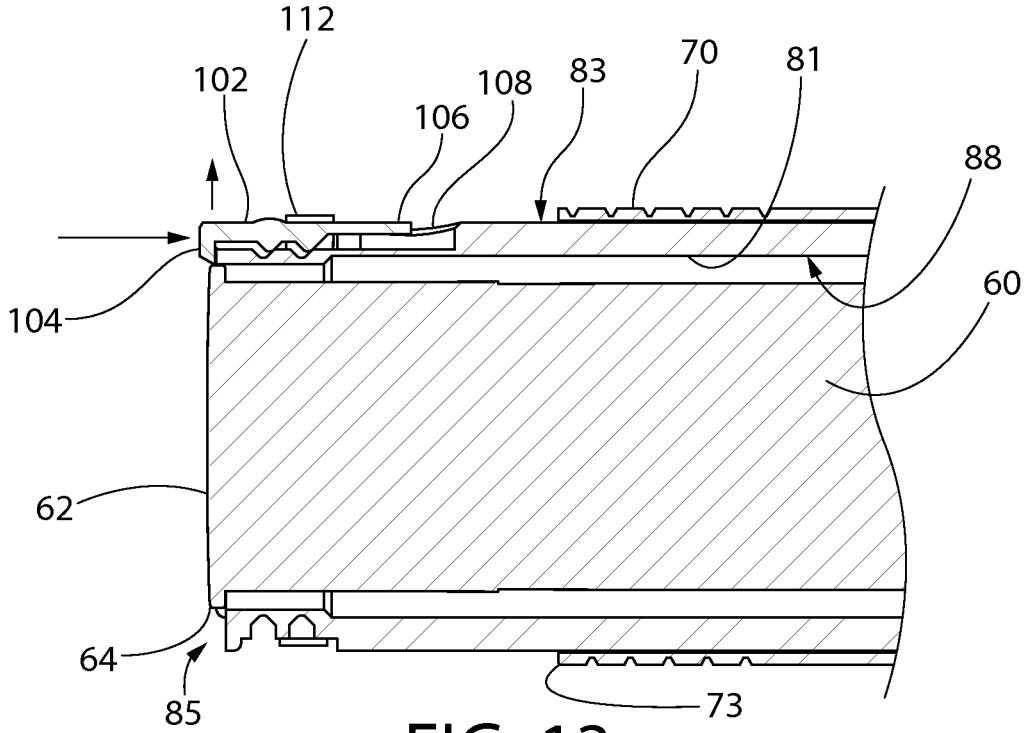
FIG. 13 is a longitudinal side cross sectional view thereof showing the rear hooks end of the shell catch lever being displaced forward which also laterally translates the front operating end and rear hooked end of the lever outwards to disengage a shell.

The shell catch lever 102 (i.e. hooked end 104) is laterally movable between an inward closed position for retaining the shells in the magazine (see, e.g. FIG. 11) and an outward open position for loading, or dispensing the shells into/from the magazine (see, e.g. FIGS. 12 and 13). Movement between these positions may be achieved by either pivoting or sliding the shell catch lever 102.

An annular-shaped spring retaining band 112 may be provided in one embodiment to bias the rear hooked end of the shell catch lever 102 towards the inward closed position into engagement with the head 62 of the shell 60. The retaining band 112 may be mounted on the rear end 85 of the magazine body 82 and is arranged so that a portion of the catch lever 102 adjacent the triangular pivot 114 is captured beneath the band between the band and rear end of the magazine tube. The retaining band 112, which engages the outer surface. 113 of the shell catch lever 102 (see, e.g. enlarged view FIG. 14B), elastically deforms and expands a small amount in diameter when pushed laterally outwards by the hooked end 104 of the shell catch lever 102 when a shell 60 is loaded forward into the magazine (associated with the open position of the lever), and then returns to its undeformed state urging the hooked end back inwards (associated with the closed position of the lever). Retaining band 112 also elastically stretches or deforms when the hooked end 104 of catch lever 102 is moved laterally outwards by pivoting or sliding the lever to release shells 60 from magazine 80. A raised spring retention protrusion 121 may be provided on the outer surface 113 of the shell catch lever 102 to the rear of retaining, band 112 may be provided to maintain the band in axial position on the lever 102. It will be appreciated that numerous other variations in the configuration and arrangement of a spring or biasing member are possible preferably so long as the hooked end of the lever is biased inwardly towards the cavity of the magazine tubular body and shells.

To facilitate manually loading shells into the magazine, the hooked end 104 of the shell catch lever includes an angled or beveled rear facing surface 104*a* (see, e.g. FIGS. 5 and 10-11) that is arranged to engage the front end of shell 60 casing when inserting/loading a shell forward into the magazine 80 tube. This pivots and temporarily displaces the hooked end 104 of the lever laterally outwards to allow the shell 60 to be loaded through the open rear end 85 of the magazine tube into the internal cavity past the hooked end. The beveled surface 104*a* faces inwards towards the axial centerline of the magazine to achieve this motion.

When the rear flange 64 (aka rim) of the shell head 62 passes immediately forward of the hooked end 104 of the lever 102, the outward lateral force applied by the shell against, the beveled surface is removed and the inwardly biased hooked end 104 pivots back laterally back inwards again to the normal closed position, FIGS. 4, 5, and 11 show the shell catch lever in the inward closed position with the hooked end 104 of the lever 102 engaging and holding a peripheral portion of the rear flange 64 of the shell. Additional shells may be loaded into the magazine in the same foregoing manner pushing the stack of shells forward with each shell added, thereby engaging the follower 87 and compressing the magazine spring 86.

To obtain the dual pivoting and sliding action of the shell catch lever 102 noted above, a pitiless pivot is provided, by a protrusion in the form of triangular shaped pivot 114 formed on the inner surface 115 of the lever (see, e.g. enlarged view FIG. 14B). Pivot 114 is seated in a complementary shaped triangular recess 116 formed on the outer surface 83 of the magazine body 82 proximate to the rear end 85. Recess 116 includes an inclined surface 118 on which a mating and opposing inclined surface 117 on pivot 114 slides. Surfaces 117 and 118 have approximately the same angle A1 with respect to the axial centerline of catch lever 102 and magazine body 82. In some embodiments, the surfaces 117 and 118 have an angle A1 between 0 and 90 degrees. Pivot 114 and recess 116 collectively form a first ramp feature 122.

When the hooked end 102 of shell catch lever 102 is pushed axially forward, sliding engagement between surfaces 117 and 118 cause the lever 102 to translate laterally outwards which laterally displaces the hooked end 102 outwards to either load or eject shells 60 from magazine 80 (see, e.g. FIG. 13 and directional arrows). This represents the sliding action of the shell catch lever 102. The operating end 104 of catch lever 102 may also translate laterally outwards in operating window 108 as shown while remaining, substantially parallel to the outer surface 83 of the tubular magazine body 82. In some embodiments, a second ramp feature 123 may be provided which is collectively formed by triangular shaped protrusion 119 seated in a complementary shaped second triangular recess 120 each having engaged inclined surfaces similar to surfaces 117, 118. Ramp feature 123 may be disposed to the rear of the ramp feature 122. This second ramp structure serves to further guide the sliding motion and concomitant lateral displacement of the catch lever 102 and booked end 104 outwards as shown in FIG. 13 (note axially displaced pivot 114 and 119 in relation to recesses 120). In some embodiments, the triangular recesses 116, 120 may be formed by circumferential grooves formed in the outer surface 83

Conversely, depressing operating end 104 of shell catch lever 102 inwards through operating window 108 pivots the hooked end 102 laterally outwards about pivot 114 (which remains fully seated in triangular recess 116) to either load or eject shells from the magazine (see, e.g. FIG. 12 and directional arrows). This represents the pivoting action of the shell catch lever 102. Each type of action may be used for different circumstances when loading/unloading shells 60 from magazine 80 either outside the Shotgun 20 or mounted in the shotgun.

The operating end 106 of the shell catch lever most conveniently functions to release the shells 60 from the magazine 80 for manual removal when the magazine is outside and dismounted from the shotgun. To manually remove shells from the magazine 80 using the pivoting action of the shell catch lever 102, a user depresses the operating end 106 laterally inwards towards and at least partially into/through the lateral window 108 in the magazine tubular body 82. This pivots the hooked end 104 of the lever 102 laterally outwards thereby disengaging the hooked end from the shell rear flange 64 and allowing the shells to be removed from the magazine (assisted by the spring-biased follower which urges the shell stack rearward towards open rear end 85).

Alternatively, to manually remove shells from the magazine 80 using the sliding action of the shell catch lever 102 instead a user may push the hooked end 102 of the catch lever 102 forward thereby sliding the catch and the operating end 106 axially forward and further into the lateral window 108 in the tubular magazine body 82. This pivots the hooked end 104 of the lever 102 outwards thereby disengaging the hooked end from the shell rear flange 64 and allowing the shells to be removed from the magazine (assisted by the spring-biased follower which urges the shell stack rearward towards open rear end 85).

To automatically feed shells 60 into the receiver 40 from the magazine 80 when mounted in the shotgun 20 for loading the action and firing the shotgun, a shell release comprising a lever 130 is provided. The shell release lever 130 interacts with the hooked end 104 of shell catch lever 102 to allow shells to be manually loaded into and retained in the magazine when the magazine is either removed from the shotgun or positioned in the shotgun. In one embodiment, the shell release lever 130 is configured and arranged to operate the shell catch lever 102 in the sliding action mode described herein.

The shell release lever 130 will be described with reference now to FIGS. 7, 13-16, and 21-22. The shell release lever 130 functions to release the shells from the magazine after the magazine has been fully mounted and inserted into the magazine housing 70. The shell release lever 130 may be pivotally mounted on a lateral side of the receiver 40 about a vertical pivot, pin 131 near the front end 45 of the receiver. In one embodiment, the shell release lever 130 may be mounted to the lower receiver 48 below the barrel 50 (best shown in FIGS. 7 and 21). In one arrangement, the lever 130 may be mounted to the left side of the receiver 40 via a U-shaped bracket 139 attached to the receiver via a cap screw 140. The bracket 139 defines an axially elongated slot 141 having an open rear end which communicates with an enlarged window 142 formed in receiver 40.

The shell release lever 130 has an elongated body including an operating end 133 on one side of the pivot 131 and an opposite working end 132 on another side of the pivot that is configured to engage the hooked end 104 of the shell catch lever 102. The operating end 133 of the lever 130 may include an enlarged operating button 134 (e.g. in height with respect to the lever body and working end 132) which allows the user to readily depress or lift the lever. Operator button 134 may be insertably received in the enlarged window 142 formed in the side of the receiver 40 so that the button may be stowed in a substantially flush manner with the receiver (see, e.g. FIGS. 7 and 22). Button 134 is laterally movable into and out of the window 142, as further described herein.

The working end 132 of shell release lever 130 includes an arcuately and convexly shaped camming surface 135 having, a forward edge 137 and rear edge 138, and an adjoining abutment surface 136 structurally contiguous with the camming surface. The abutment surface 136 may be flat as in the embodiment shown.

The shell catch lever 130 operably interacts with the shell catch lever 102 to release shells from the magazine 80 when fully seated in the magazine housing 70. The shell release lever is pivotally moveable between an outward deactivated position shown in FIG. 14 and an inward activated shell release position shown in FIG. IS.

Figure 22:
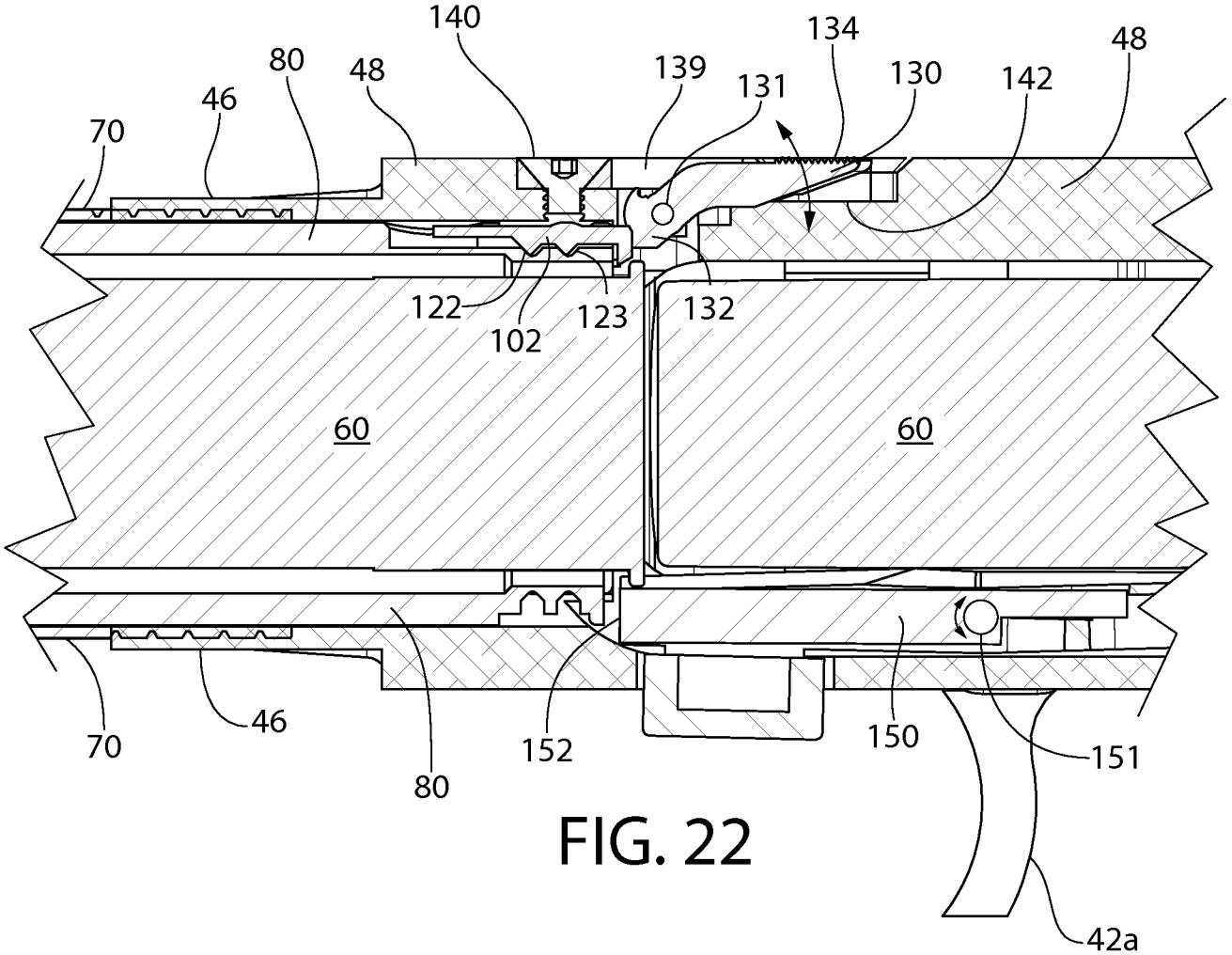
FIG. 22 is a bottom cross-sectional view of the receiver and rear end of the magazine showing the shell catch and release levers with the catch lever in the outward open position dispensing, a shell.

In operation of the tubular magazine 80, the shell release lever 130 is first placed in the deactivated position shown in FIGS. 14 and 22. The operating end 133 of the shell release lever is pivoted to a maximum extent laterally outward from the receiver 40, and in one non-limiting embodiment may be generally perpendicular to the magazine body 82 as shown. The magazine 80 is then fully inserted into the magazine housing 70. This positions the shell catch lever 102 mounted on the rear end 85 of the magazine tube near the shell release lever 130 mounted on the receiver 40. The forward edge 137 of the camming surface 135 on the shell catch lever 102 is now positioned immediately rearward of the flat rear-facing abutment surface 104*b* on the hooked end 104 of the shell catch lever, as shown in FIGS. 14A and 14B. At this point, the shells 60 are still retained in the magazine 80 by the shell catch lever 102 which has not been activated yet.

Figure 15A:
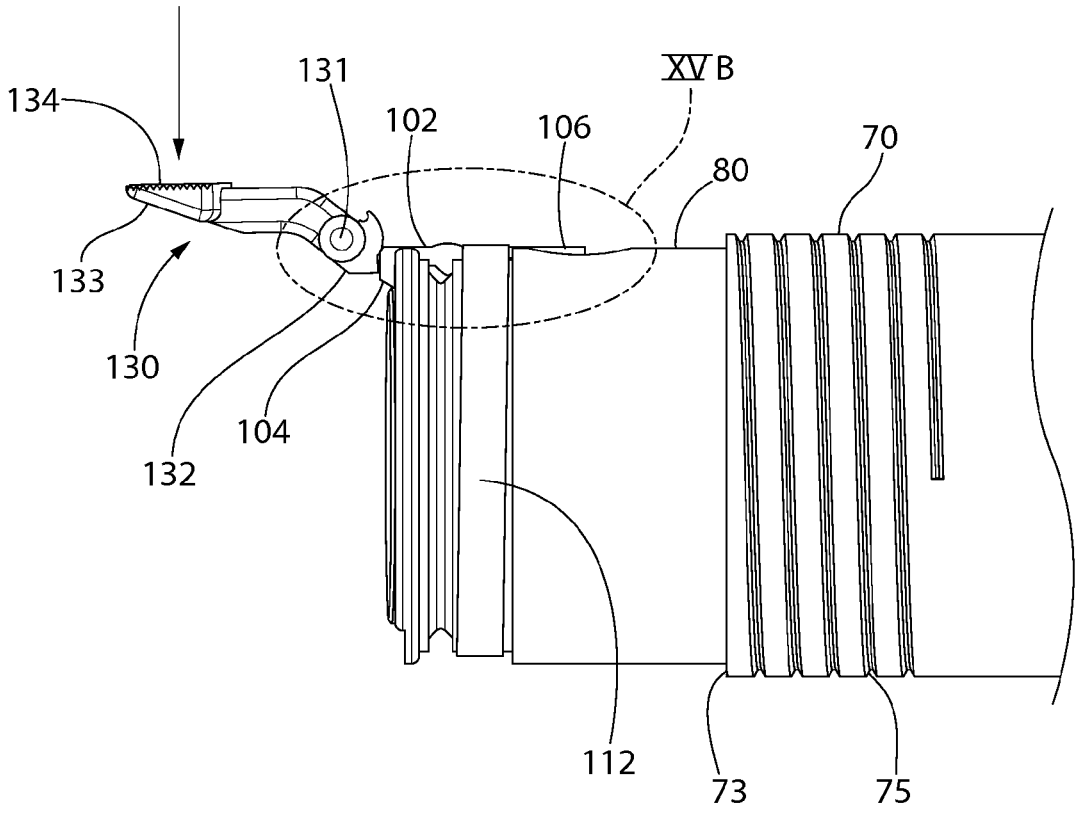
FIG. 15A is a side elevation view of the rear end of the magazine showing the shell, release lever in an inward deactivated release position engaging and moving the shell catch lever to the outward open position.
Figure 15B:
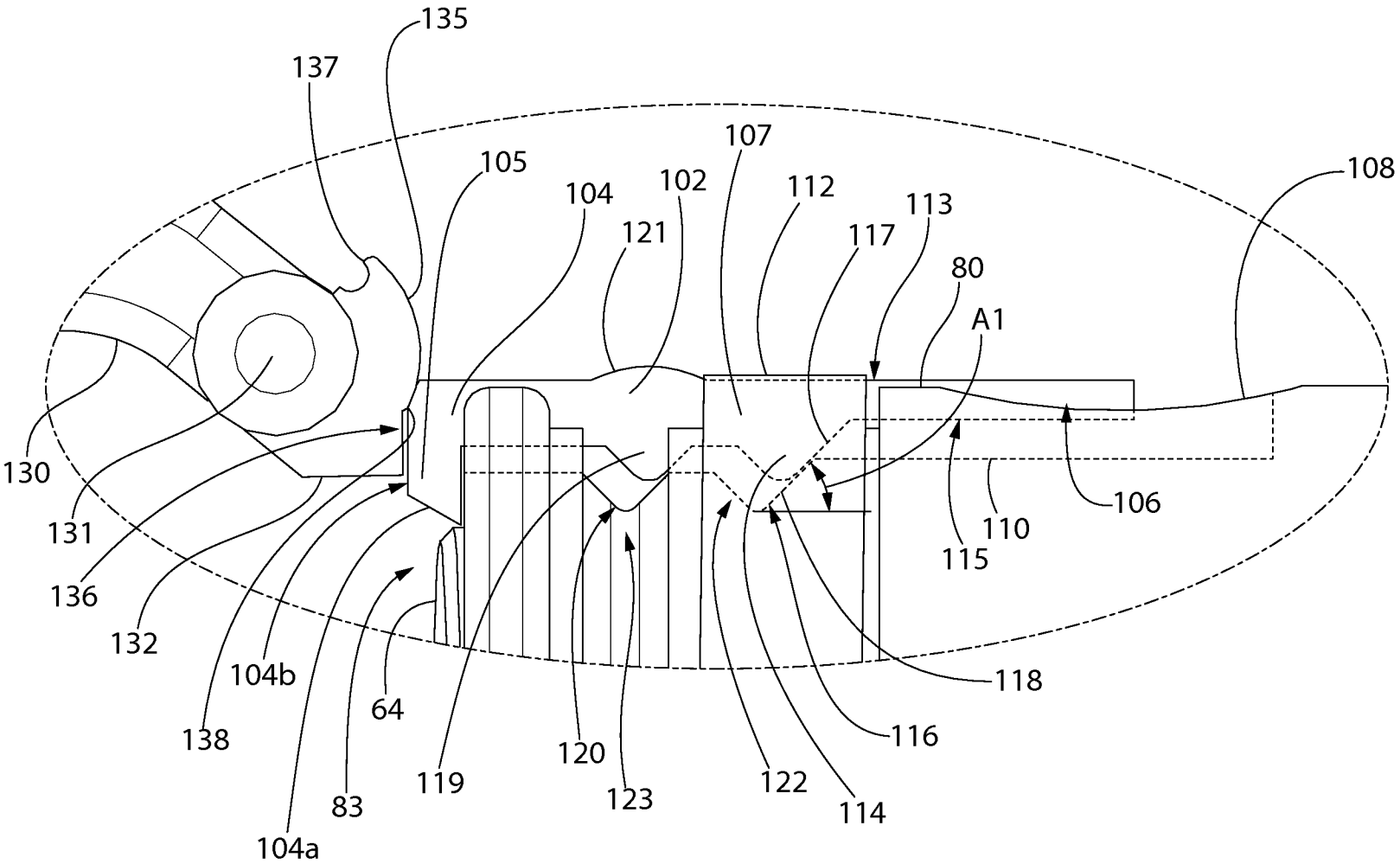
FIG. 15B is an enlarged view from FIG. 15A.
Figure 16:
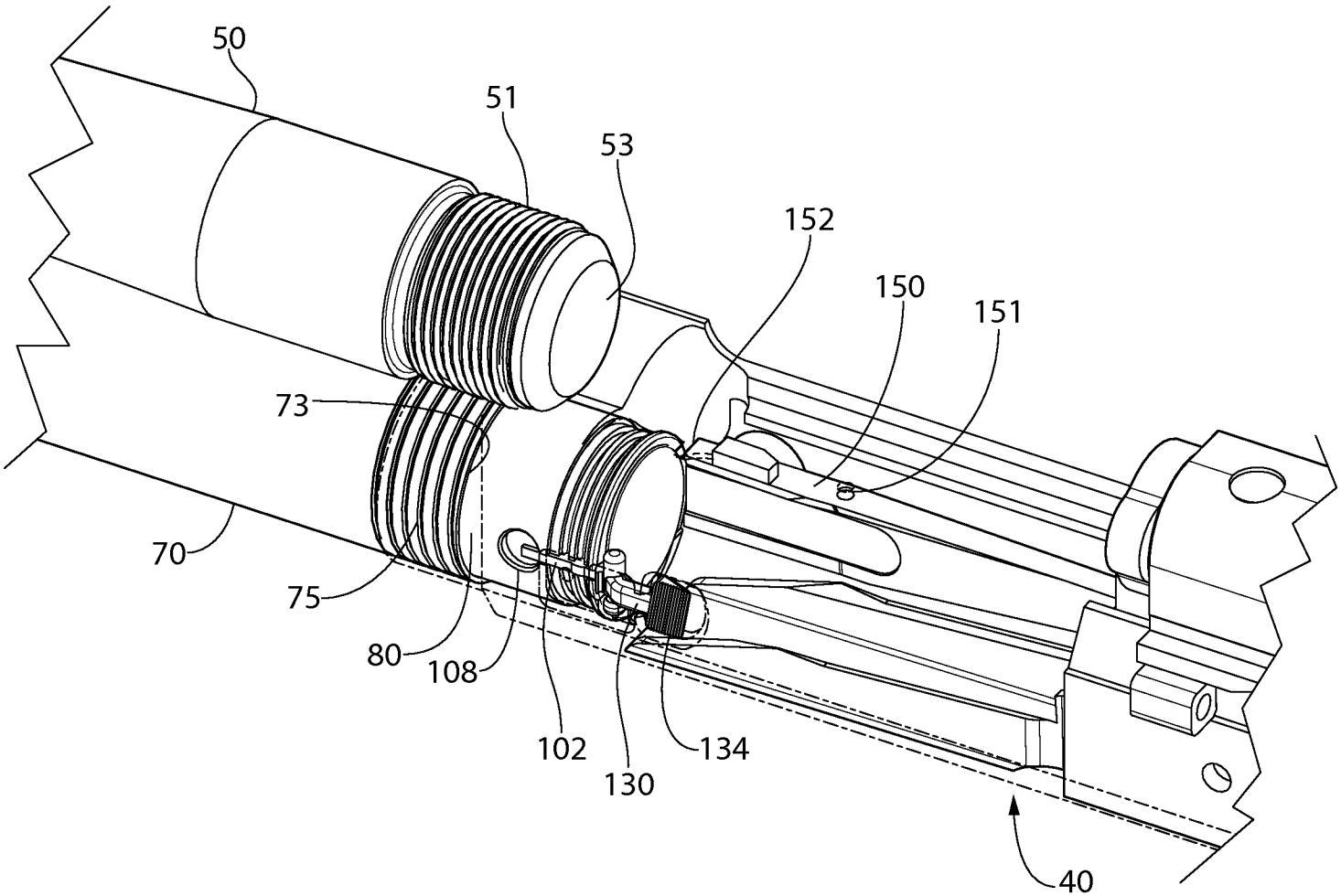
FIG. 16 is a left perspective view of an open action or breech of the firearm showing the magazine positioned in the magazine housing for feeding shells into the receiver.

The user next presses the button 134 on the operating end 133 of the shell release lever 130 rearwards and inwards towards the receiver 40 to move the release lever to the activated shell release position shown in FIG. 15. This action pivots the forward edge 137 of the camming surface 135 on the shell release lever 130 outwards and into further engagement with the flat abutment surface 104*b* on the shell catch lever. The arcuately curved camming surface 135 progressively rides/slides along the abutment surface 104*h* of the shell catch lever 102 from the forward edge 137 towards the rear edge 138, thereby camming and advancing the catch lever 102 slightly forward axially. This causes mating angled and inclined surfaces 117, 118 on catch lever 102 and the magazine 80 tube to slide against each other as shown in FIGS. 13 and 14B, which in turn laterally displaces the shell catch lever 102 outwards by a sufficient amount to disengage the hooked end. 102 of the catch lever from the rear flange 64 of the shell 60. The angled and inclined surfaces 117, 118 translate an axial movement of the shell catch lever 102 caused by the shell release lever camming surface 135 into corresponding lateral motion of the catch lever 102.

Figure 17:
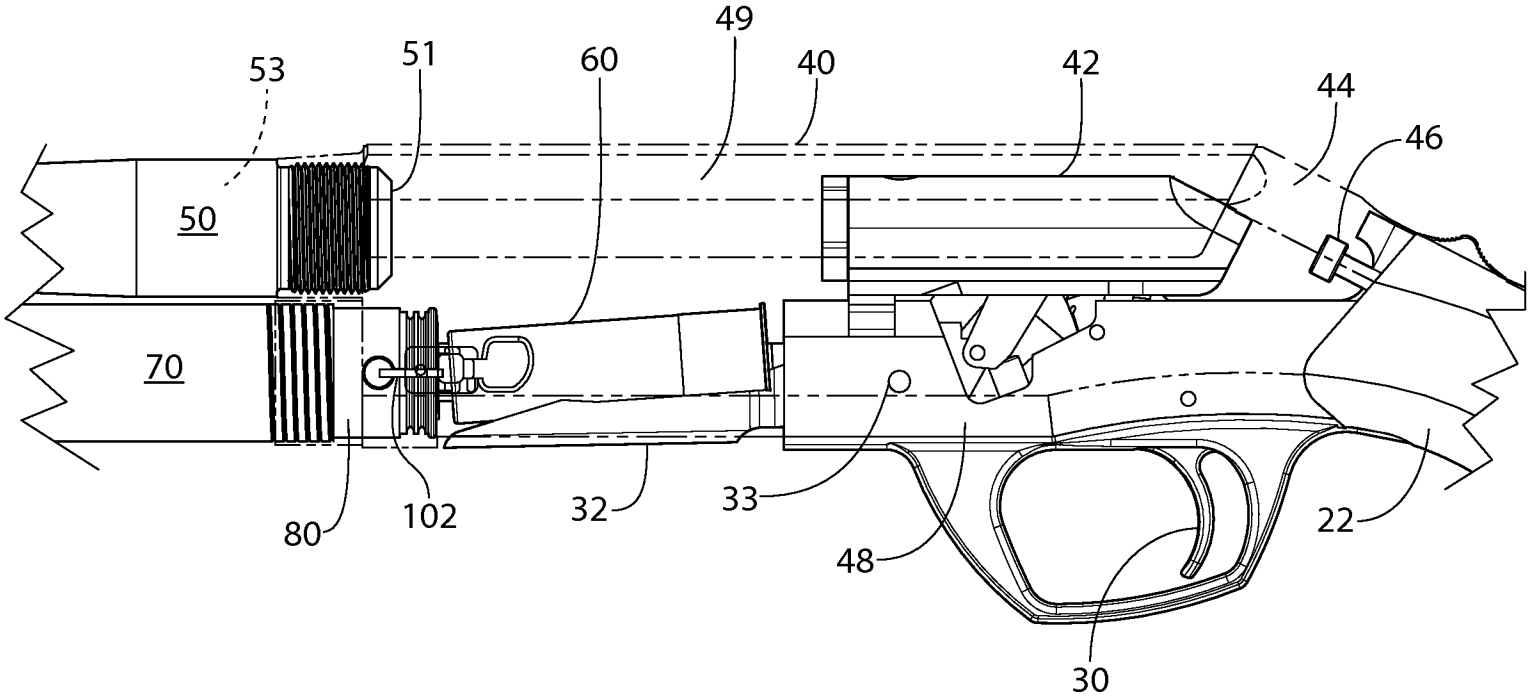
FIG. 17 is a left side elevation cutaway view showing a shell being dispensed from the magazine into the lower receiver.
Figure 18:
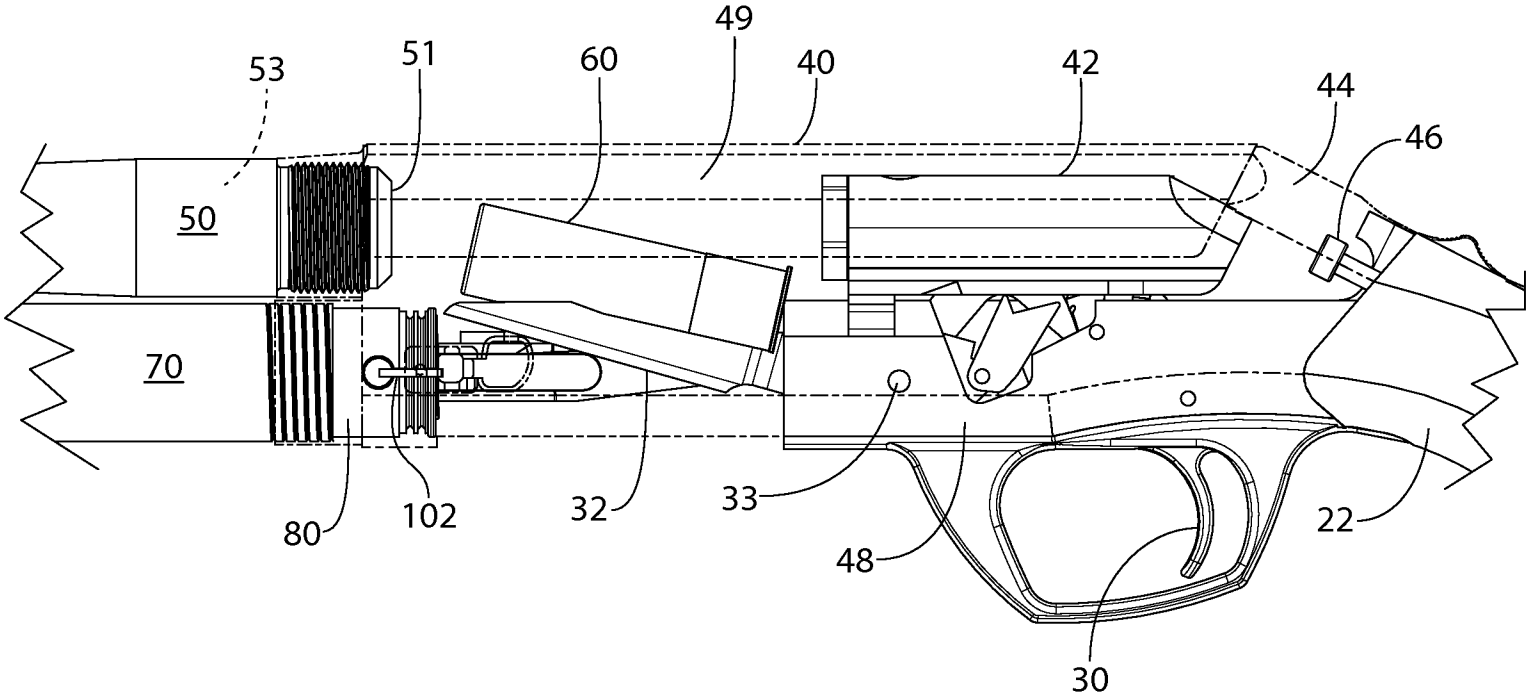
FIG. 18 is a left side elevation cutaway view showing the shell being raised into the upper receiver by the carrier for chambering.
Figure 19:
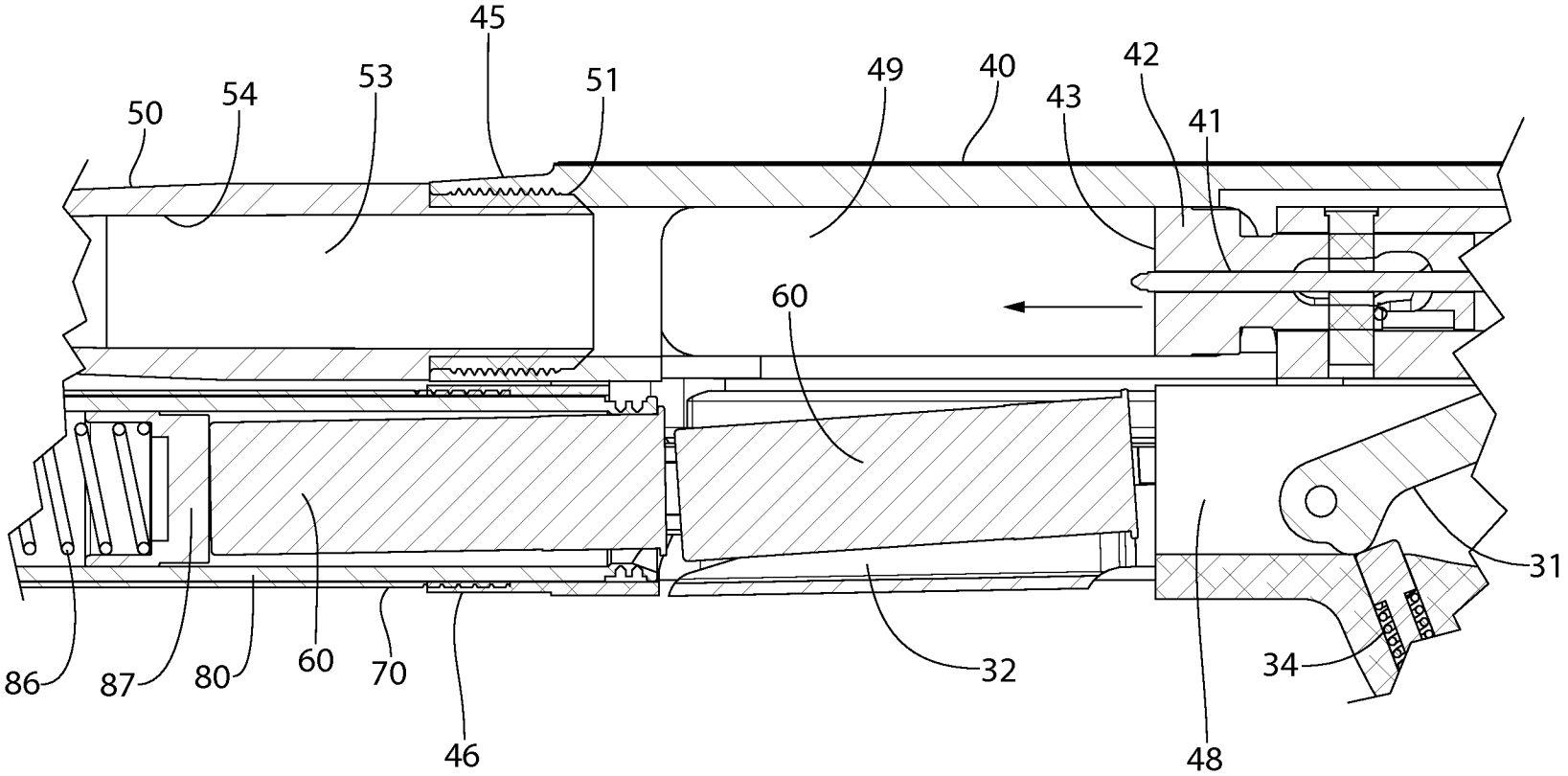
FIG. 19 is a left side cross-sectional view showing a shell being dispensed from the magazine into the lower receiver.
Figure 20:
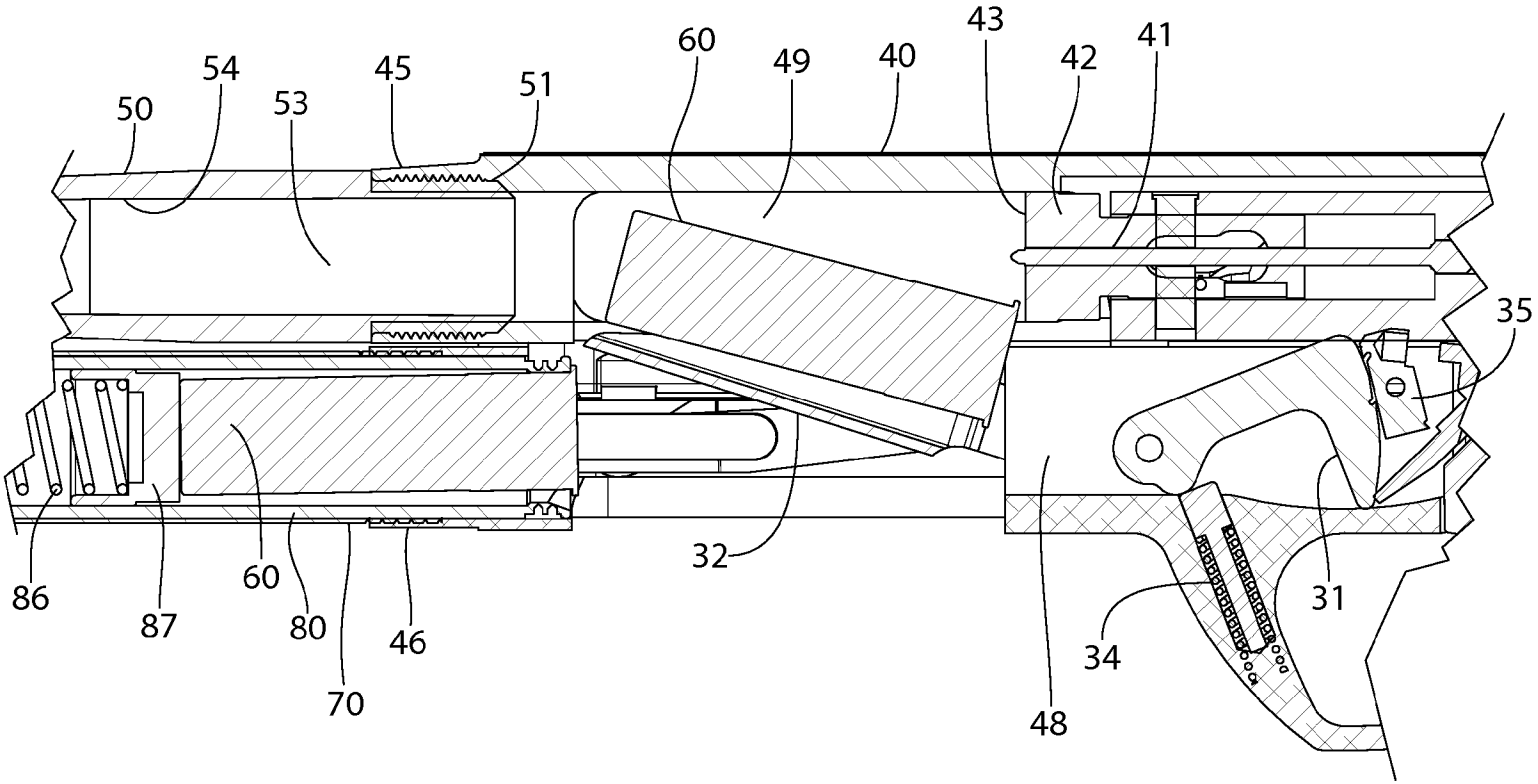
FIG. 20 is a left side cross-sectional view showing the shell being raised into the upper receiver by the carrier for chambering.
Figure 21:
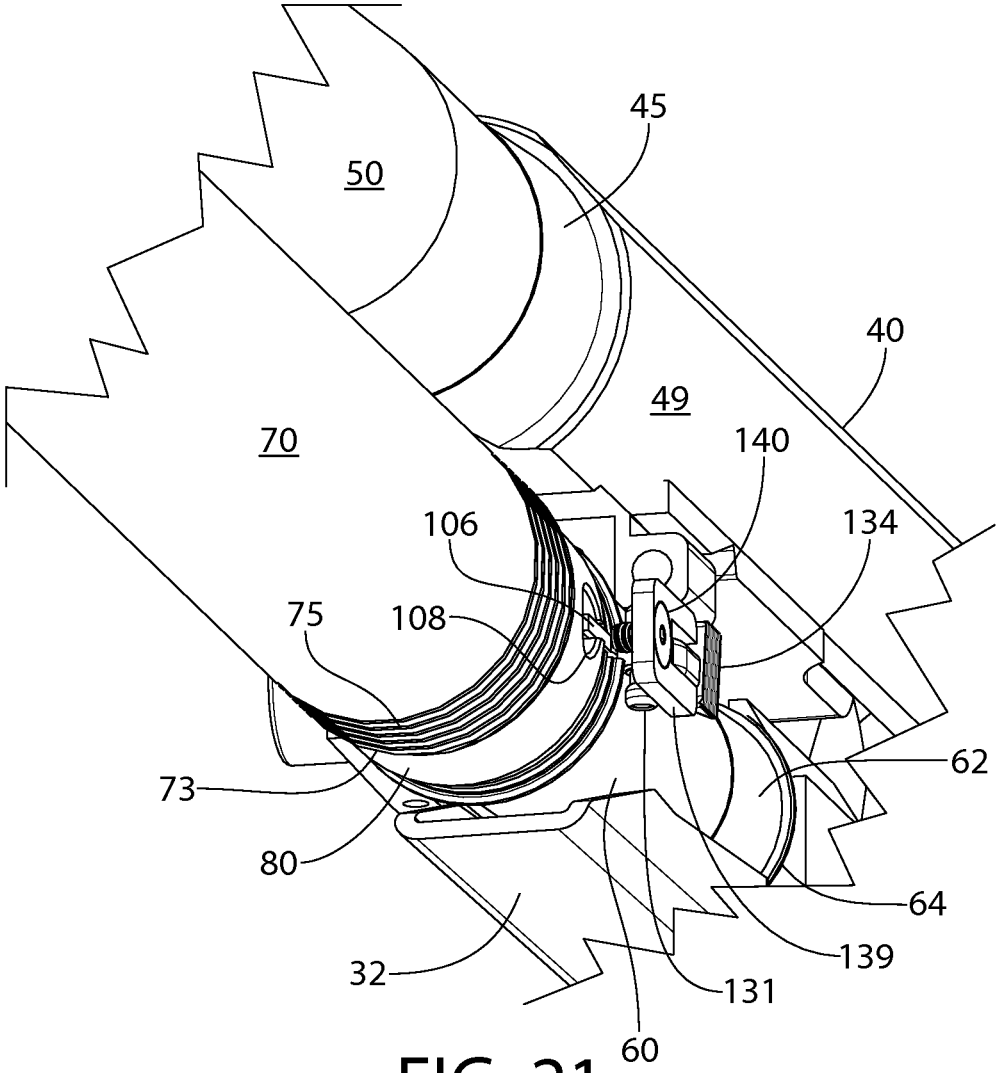
FIG. 21 is a bottom perspective view (looking rearwards) showing the rear end of magazine and shell release lever with a shell being dispensed into the receiver.

As the shell release lever further moves towards the activated shell release position, the now front facing abutment surface 136 on the working end 132 of the shell release lever 130 rotates into engagement with the rear facing abutment surface 104*b* of the shell catch lever 102, thereby holding the catch lever in the forward advanced and outwardly displaced position produced by the camming surface action. This abutting engagement is maintained as long as the shell release lever 130 remains in the inward activated shell release position. The axial stack of shells 60 in the magazine 80 are then released and automatically fed rearward by the spring-biased follower 87 into the receiver 40 and action as shown in FIGS. 17 and 19. The pivoting carrier 32 mounted in the lower receiver then receives and raises the rearmost shells 60 upwards into the upper receiver 49 from which position the shells may be pushed into the barrel chamber 51 by the bolt 42 upon closing the breech, as shown in FIGS. 18 and 20.

Referring to MG. 16, once the stack shells are released from the magazine 80 with the shell release lever 130 in the activated position, the pivoting magazine latch 150 mounted in the receiver 40 about a vertical pivot pin 151 on the opposite right side of shotgun 20 engages the rear flange 64 of the rearmost remaining shell 60 in the magazine to control the further feed of shells into the breech in a conventional regulated fashion. The magazine latch 150 cooperates with the carrier 32 to time and control the release of shells 60 from the magazine 80 so that only a single shell is loaded onto the carrier and raised into the breech area at a time to prevent jams. The shell catch 152 on the front end of the magazine latch 150 is configured and arranged at the rear end 85 of the magazine 80 as shown to actively engage the rearmost shell 60 in the magazine. When the action is cycled such as by firing the shotgun 20, the magazine latch 150 is pivoted by the action to move the magazine catch 152 laterally outwards away from the rear end 85 of magazine 80. This disengages the magazine catch 152 from the rearmost shell 60 which is then released to the carrier 32 to load another round into the barrel chamber 51. This process is repeated each time the shotgun is fired.

In an exemplary method for using the present magazine assembly to load ammunition into the shotgun 20, a full stack of shells may be loaded into one or more magazines 80 outside of the shotgun 20. The shell catch lever 120 alternatingly laterally translated or pivots inward and outward between the closed and open positions respectively in the manner already described as each shell 60 is loaded. The magazine tube is then axially aligned with the magazine housing 70 and internal cavity 74 as shown in FIGS. 2 and 3. The rear hooked end 104 of a shell catch lever 102 and loaded magazine 80 is then axially inserted in a rearward axial direction (parallel to longitudinal axis LA) through the open front end 72 of the magazine housing 70. The magazine tube is inserted until fully seated in the magazine housing such that the forearm end cap 27 on the magazine abuts the forward end portion 29 of the forearm 24 affixed to the shotgun, as shown in FIG. 1. This also locates the shell catch lever 102 properly with respect to the shell release lever 130 as described above. It bears noting that the shells 60 have not yet been released to the receiver 40, but are still retained in the magazine 80 by action of the hooked end 104 of the shell catch lever 102. The shells 60 are positioned horizontally in stacked end-to-end relationship within the magazine 80 in the shotgun.

It should be noted that the forearm end cap 27 on the magazine 80 assists the user with ensuring that the magazine is inserted into the magazine housing 70 with the correct rotational orientation by matching the contours on the forearm 24 and end cap. This is advantageous because the rear end 85 of the magazine 80 is located inside the magazine housing 70 and beneath the forearm 24 which precludes the user from directly observing the location and position of the shell catch lever 102 with respect to the shell release lever 130 on the receiver 40. In some embodiments, alignment indicia (e.g. match lines on magazine or end cap and the forearm) may be provided to assist with achieving the proper rotational orientation in addition to or instead of relying on the forearm and end cap contour matching.

To load the shells 60 into the receiver 40 and ready the shotgun 20 for firing, the user depresses and rotates the operating button 134 inwards on the shell release lever 130 to the inward active position in the manner previously described (see, e.g. FIG. 15A). This concomitantly moves the shell catch lever 102 to the laterally displaced open position, releasing the last loaded shell (i.e. rearmost) in the magazine 80 from the hooked end 104 of the lever 102 (see, e.g. FIG. 13). The spring-biased follower 87 pushes the stack of shells 60 rearward towards the receiver 40 and action of the shotgun loading the shell onto the carrier 32 (see, e.g. FIGS. 17 and 19). The rearmost shell in the horizontal stack entering the receiver 40 may then be uploaded into the chamber 53 by the carrier 32 (see FIGS. 18 and 20) and closing the action and breech (e.g. moving the bolt 42 forward). After firing the shotgun 20 via the trigger 30 operated firing mechanism, the spent shell casing is extracted in the usual manner and ejected through an ejection port 36 in the shotgun by cycling the action either manually in the case of a pump action shotgun or automatically in the case of an inertia/gas loading system shotgun design. The next available shell 60 at the rear of the stack is loaded into the chamber 53 in the manner already described.

When the magazine is emptied, the magazine may be removed from the shotgun by unlocking the magazine using lock pin 91 and axially withdrawing the magazine 80 tube from the magazine housing forward in a reverse manner to that already described above. The shell catch lever 102 will automatically close. In some situations this retains an remaining shells in the magazine 80 if not full empty upon withdrawing the tubular magazine from its housing 70 without first lifting and returning the shell release lever 130 to the deactivated outward position. Breaking contact between the shell catch lever 102 and shell release lever 130 automatically laterally returns the spring-biased shell catch lever to the inward closed position for retaining the shells in the magazine 80. Optionally, if desired, the shell release lever 130 may first be moved to the inactive position (see, e.g. FIG. 14A) by lifting the operating end 133 of the shell release lever outwards from the receiver 40 before unlocking and removing the empty or partially empty magazine, in either of the foregoing operating scenarios, a new fully loaded magazine may then be inserted into the magazine housing and readied for firing in the manner described above.

Advantages and features of a magazine assembly according to the present disclosure include (a) a magazine can be loaded with and retain shells outside of the shotgun, (b) with the magazine inserted into the shotgun, the magazine can still be loaded in the traditional way if desired by placing a shell into the magazine thru the opening in the underside of the shotgun at the pivoting carrier location, (c) a loaded magazine can be inserted into the shotgun without cycling the action, (d) once a loaded magazine is placed into the shotgun, the shell release lever via the button must be pressed inwards before rounds can be fed from the magazine, and (e) a loaded magazine can be removed from the shotgun while retaining the unused shells.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit, of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A magazine assembly for a firearm, the assembly comprising:

an outer magazine housing configured for attachment to a firearm having a longitudinal axis defining an axial direction;

an elongated magazine removably insertable into the housing, the magazine including an open rear end and axially extending internal cavity configured to hold a plurality of shells in stacked end-to-end relationship; and a shell catch lever slideably mounted at the rear end of the magazine for linear movement parallel to the longitudinal axis, the shell catch lever configured to retain the shells in the magazine in a first lateral position and release the shells from the magazine in a second lateral position;

wherein the shell catch lever is configured and operable to retain and release the shells when removed from the magazine housing to allow the magazine to be preloaded before insertion into the housing;

wherein the shell catch lever is further pivotably mounted on the magazine for lateral movement transverse to the longitudinal axis between the first and second lateral positions by rotating the shell catch lever;

wherein the pivot comprises a triangular protrusion formed on an inner surface of the shell catch lever that engages a complementary configured recess formed in an outer surface of the magazine.

2. The assembly according to claim 1, wherein the shell catch lever is laterally displaceable with respect to the magazine to move from the first to second lateral positions by sliding the shell catch lever in a forward axial direction.

3. The assembly according to claim 2, wherein the shell catch lever includes an inclined surface which slideably engages a mating inclined surface on the magazine, the engaged inclined surfaces translating linear movement of the shell catch lever into the lateral movement.

4. The assembly according to claim 1, wherein the shell catch lever includes a pinless pivot that engages the magazine to form the pivotable mount.

5. A magazine assembly for a firearm, the assembly comprising:

an outer magazine housing configured for attachment to a firearm having a longitudinal axis defining an axial direction;

an elongated magazine removably insertable into the housing, the magazine including an open rear end and axially extending internal cavity configured to hold a plurality of shells in stacked end-to-end relationship; and a shell catch lever slideably mounted at the rear end of the magazine for linear movement parallel to the longitudinal axis, the shell catch lever configured to retain the shells in the magazine in a first lateral position and release the shells from the magazine in a second lateral position;

wherein the shell catch lever is configured and operable to retain and release the shells when removed from the magazine housing to allow the magazine to be preloaded before insertion into the housing;

wherein the shell catch lever is further pivotably mounted on the magazine for lateral movement transverse to the longitudinal axis between the first and second lateral positions by rotating the shell catch lever;

wherein the pivot comprises a triangular protrusion formed on an inner surface of the shell catch lever that engages a complementary configured recess formed in an outer surface of the magazine;

wherein pushing an operating end of the shell catch lever inwards laterally displaces a rear hooked end of the shell catch lever outwards to release shells from the magazine when the shell catch lever is in the second position.

6. The assembly according to claim 1, wherein the magazine is axially insertable and removable from the housing in a direction parallel to the longitudinal axis.

7. A magazine assembly for a firearm, the assembly comprising:

an outer magazine housing configured for attachment to a firearm having a longitudinal axis defining an axial direction;

an elongated magazine removably insertable into the housing, the magazine including an open rear end and axially extending internal cavity configured to hold a plurality of shells in stacked end-to-end relationship; and a shell catch lever slideably mounted at the rear end of the magazine for linear movement parallel to the longitudinal axis, the shell catch lever configured to retain the shells in the magazine in a first lateral position and release the shells from the magazine in a second lateral position;

wherein the shell catch lever is configured and operable to retain and release the shells when removed from the magazine housing to allow the magazine to be preloaded before insertion into the housing;

wherein the shell catch lever is further pivotably mounted on the magazine for lateral movement transverse to the longitudinal axis between the first and second lateral positions by rotating the shell catch lever;

wherein the pivot comprises a triangular protrusion formed on an inner surface of the shell catch lever that engages a complementary configured recess formed in an outer surface of the magazine;

wherein the magazine housing has an axially elongated tubular shape.

8. The assembly according to claim 1, further comprising a pivotably mounted shell release lever, the shell release lever configured to engage a rear hooked end of the shell catch lever for sliding the shell catch lever axially forward to release a shell from the magazine.

9. The assembly according to claim 1, further comprising a laterally movable lock pin configured to engage and retain the magazine in the housing, the lock pin movable between a locked position preventing the magazine from being axially withdrawn from the housing and a release position allowing the magazine to be axially withdrawn from the housing.

10. The assembly according to claim 1, further comprising a shell release lever engageable with the shell catch lever, the shell release lever moveable in a pivotable motion to move the shell catch lever between the first and second positions.

* * * * *